US008314663B2

(12) United States Patent
Tamaru et al.

(10) Patent No.: US 8,314,663 B2
(45) Date of Patent: Nov. 20, 2012

(54) DIRECTIONAL COUPLER

(75) Inventors: Ikuo Tamaru, Nagaokakyo (JP); Kiyoshi Aikawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/411,858

(22) Filed: Mar. 5, 2012

(65) Prior Publication Data

US 2012/0161897 A1 Jun. 28, 2012

Related U.S. Application Data

(63) Continuation of application No. PCT/JP2010/070537, filed on Nov. 18, 2010.

(30) Foreign Application Priority Data

Dec. 18, 2009 (JP) ..... 2009-287061

(51) Int. Cl.
*H01P 5/12* (2006.01)
*H01P 3/08* (2006.01)

(52) U.S. Cl. ..... 333/109; 333/116

(58) Field of Classification Search ..... 333/109, 333/110, 111, 112, 115, 116
See application file for complete search history.

(56) References Cited

U.S. PATENT DOCUMENTS

| | | | | |
|---|---|---|---|---|
| 5,424,694 | A | 6/1995 | Maloratsky et al. | |
| 7,027,779 | B2 * | 4/2006 | Tai et al. | 455/83 |
| 7,218,186 | B2 * | 5/2007 | Chen | 333/116 |

FOREIGN PATENT DOCUMENTS

| | | | |
|---|---|---|---|
| JP | 61-10327 | Y2 | 4/1986 |
| JP | 8-237012 | A | 9/1996 |
| JP | 2001-94315 | A | 4/2001 |
| JP | 2005-184631 | A | 7/2005 |

OTHER PUBLICATIONS

Official Communication issued in International Patent Application No. PCT/JP2010/070537, mailed on Feb. 8, 2011.

* cited by examiner

*Primary Examiner* — Dean O Takaoka
(74) *Attorney, Agent, or Firm* — Keating & Bennett, LLP

(57) ABSTRACT

A directional coupler that has a degree of coupling that is close to constant and is to be used in a predetermined frequency band includes a main line between a first outer electrode and a second outer electrode. A sub-line is provided between a third outer electrode and a fourth outer electrode and is electromagnetically coupled with the main line. A low pass filter is provided between the third outer electrode and the sub-line and has a characteristic in which attenuation increases with increasing frequency in a predetermined frequency band.

15 Claims, 18 Drawing Sheets

DIRECTIONAL COUPLER

BACKGROUND OF THE INVENTION

1. Field of the Invention

The present invention relates to directional couplers and more particularly relates to directional couplers that are preferably used in, for example, wireless communication devices that perform communication using high-frequency signals.

2. Description of the Related Art

The directional coupler described in Japanese Unexamined Patent Application Publication No. 8-237012 is a known example of a conventional directional coupler. This directional coupler is formed by stacking a plurality of dielectric layers, on which coil-shaped conductors and ground conductors have been formed, on top of one another. Two of the coil-shaped conductors are provided. One of the coil-shaped conductors forms a main line and the other coil-shaped conductor forms a sub-line. The main line and the sub-line are electromagnetically coupled with each other. Furthermore, the coil-shaped conductors are interposed between the ground conductors in the direction in which the layers are stacked. A ground potential is applied to the ground conductors. In the above-described directional coupler, when a signal is input to the main line, a signal is output from the sub-line, the signal having a power that is proportional to the power of the input signal.

However, there is a problem with the directional coupler described in Japanese Unexamined Patent Application Publication No. 8-237012, in that the degree of coupling between the main line and the sub-line becomes higher as the frequency of a signal input to the main line increases (that is, the degree of coupling characteristic is not constant). Consequently, even if signals having the same power are input to the main line, if the frequencies of the signals vary, the powers of the signals output from the sub-line will also vary. Therefore, it is necessary that an IC, which is connected to the sub-line, have a function of correcting the power of a signal on the basis of the frequency of the signal.

SUMMARY OF THE INVENTION

Accordingly, preferred embodiments of the present invention achieve a degree of coupling characteristic that is close to constant in a directional coupler.

A directional coupler according to a preferred embodiment of the present invention is to be used in a predetermined frequency band and includes first to fourth terminals; a main line that is connected between the first terminal and the second terminal; a first sub-line that is connected between the third terminal and the fourth terminal and that is electromagnetically coupled with the main line; and a first low pass filter that is connected between the third terminal and the first sub-line and has a characteristic in which attenuation increases with increasing frequency in the predetermined frequency band.

According to various preferred embodiments of the present invention, the degree of coupling characteristic can be close to constant in a directional coupler.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereafter, directional couplers according to preferred embodiments of the present invention will be described.

First Preferred Embodiment

Figure 1:
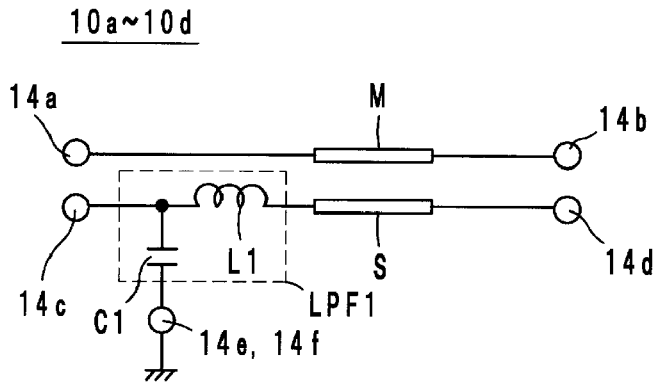
FIG. 1 is an equivalent circuit diagram of a directional coupler according to any of first to fourth preferred embodiments of the present invention.

Hereafter, a directional coupler according to a first preferred embodiment will be described while referring to the drawings. FIG. 1 is an equivalent circuit diagram for any of directional couplers 10*a* to 10*d* according to first to fourth preferred embodiments of the present invention.

The circuit configuration of the directional coupler 10*a* will now be described. The directional coupler 10*a* is to be used in a predetermined frequency band. Examples of the predetermined frequency band include 824 MHz to 1910 MHz in the case where a signal having a frequency of 824 MHz to 915 MHz (GSM 800/900) and a signal having a frequency of 1710 MHz to 1910 MHz (GSM 1800/1900) are input to the directional coupler 10*a*.

The directional coupler 10*a* preferably includes outer electrodes (terminals) 14*a* to 14*f*, a main line M, a sub-line S and a low pass filter LPF1, as a circuit configuration. The main line M is connected between the outer electrodes 14*a* and 14*b*. The sub-line S is connected between the outer electrodes 14*c* and 14*d* and is electromagnetically coupled with the main line M.

In addition, the low pass filter LPF1 is connected between the outer electrode 14*c* and the sub-line S and has a characteristic in which attenuation increases with increasing frequency in a predetermined frequency band. The low pass filter LPF1 includes a capacitor C1 and a coil L1. The coil L1 is connected in series between the outer electrode 14*c* and the sub-line S. The capacitor C1 is connected between a point between the sub-line S and the outer electrode 14*c* (more precisely a point between the coil L1 and the outer electrode 14*c*), and the outer electrodes 14*e* and 14*f*.

In the above-described directional coupler 10*a*, the outer electrode 14*a* is used as an input port and the outer electrode 14*b* is used as an output port. Furthermore, the outer electrode 14*c* is used as a coupling port and the outer electrode 14*d* is used as a termination port that is terminated at about 50Ω, for example. The outer electrodes 14*e* and 14*f* are used as ground ports, which are grounded. When a signal is input to the outer electrode 14*a*, the signal is output from the outer electrode 14*b*. Furthermore, since the main line M and the sub-line S are electromagnetically coupled with each other, a signal having a power that is proportional to the power of the input signal is output from the outer electrode 14*c*.

Figure 2:
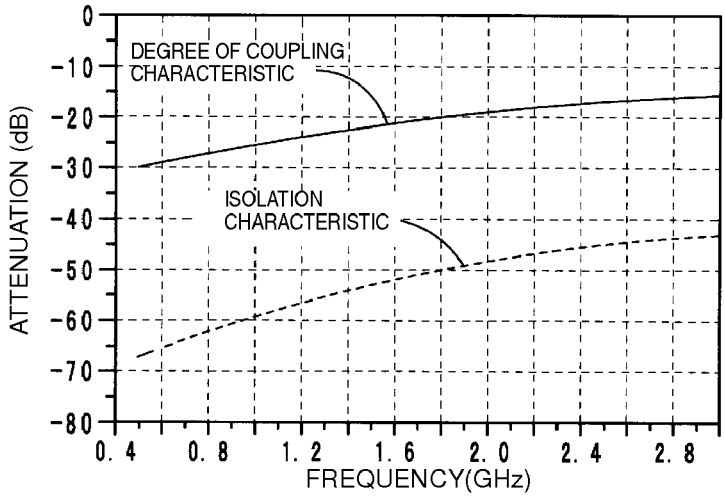
FIG. 2 is a graph illustrating a degree of coupling characteristic and an isolation characteristic of a conventional directional coupler that does not contain a low pass filter.
Figure 3:
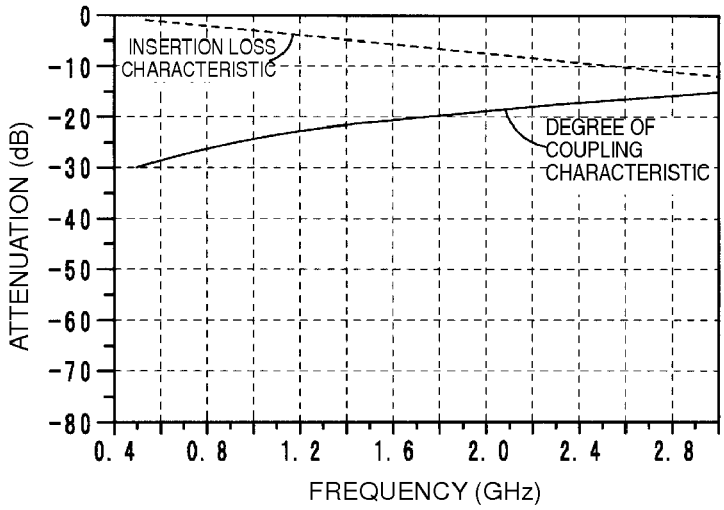
FIG. 3 is a graph illustrating a degree of coupling characteristic of a conventional directional coupler that does not contain a low pass filter and an insertion loss characteristic of a low pass filter.
Figure 4:
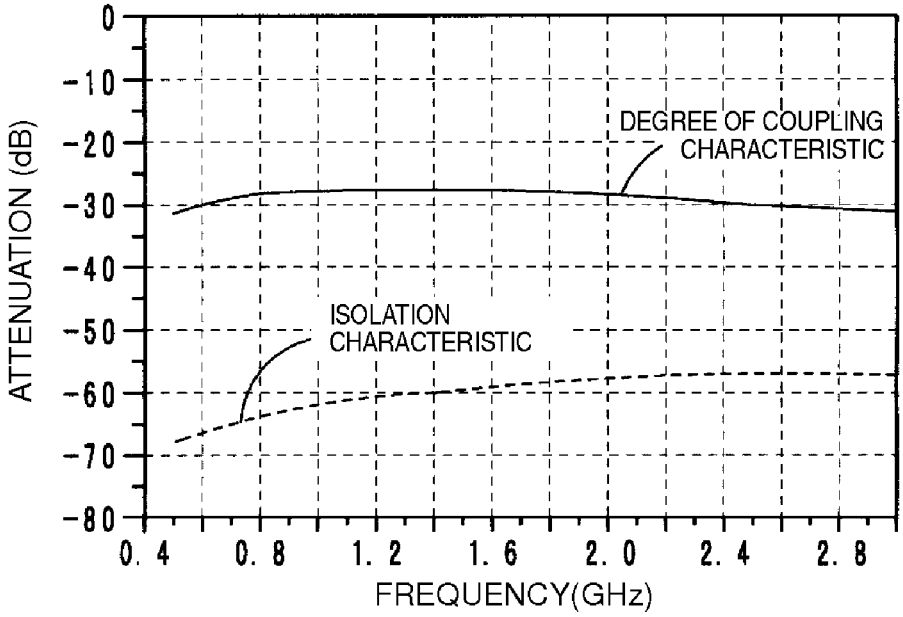
FIG. 4 is a graph illustrating a degree of coupling characteristic and an isolation characteristic of a directional coupler according to a first preferred embodiment of the present invention.

With the directional coupler 10*a* having the above-described circuit configuration, as will be described below, it is possible to make the degree of coupling characteristic close to constant. FIG. 2 is a graph illustrating a degree of coupling characteristic and an isolation characteristic of a conventional directional coupler that does not contain the low pass filter LPF1. FIG. 3 is a graph illustrating a degree of coupling characteristic of a conventional directional coupler that does not contain the low pass filter LPF1 and an insertion loss characteristic of the low pass filter LPF1. FIG. 4 is a graph illustrating a degree of coupling characteristic and an isolation characteristic of the directional coupler 10*a*. Simulation results are illustrated in FIGS. 2 to 4. The degree of coupling characteristic is the relation between the ratio of the power of a signal input to the outer electrode 14*a* (input port) to the power of a signal output from the outer electrode 14*c* (coupling port) (i.e., attenuation) and frequency. The isolation characteristic is the relation between the ratio of the power of a signal input from the outer electrode 14*b* (output port) to the power of a signal output from the outer electrode 14*c* (coupling port) (i.e., attenuation) and frequency. In addition, the insertion loss characteristic is the relation between the attenuation of the low pass filter and frequency. In FIGS. 2 to 4, the vertical axis represents attenuation and the horizontal axis represents frequency.

In the conventional directional coupler, the degree of coupling between the main line and the sub-line increases as the frequency of a signal increases. Therefore, as illustrated in FIG. 2, the ratio of power input from the input port to power output to the coupling port increases with increasing frequency in the degree of coupling characteristic of the conventional directional coupler.

Accordingly, in the directional coupler 10*a*, the low pass filter LPF1 is connected between the outer electrode 14*c* and the sub-line S. The low pass filter LPF1, as illustrated in FIG. 3, has an insertion loss characteristic in which attenuation increases with increasing frequency. Consequently, even when the power of a signal output from the sub-line S to the outer electrode 14*c* increases due to the frequency of the signal increasing, the power of the signal is reduced by the low pass filter LPF1. As a result, as illustrated in FIG. 4, the degree of coupling characteristic can be close to constant in the directional coupler 10*a*.

In the predetermined frequency band, it is preferable that the average value of the slope of the degree of coupling characteristic for a section of the directional coupler 10*a* excluding the low pass filter LPF1 (that is, the main line M and the sub-line S) and the average value of the slope of the insertion loss characteristic of the low pass filter LPF1 have opposite signs and have substantially equal absolute values. This makes it possible for the degree of coupling characteristic of the directional coupler 10*a* to be made even closer to being constant.

Furthermore, comparing the isolation characteristic of the directional coupler 10*a* illustrated in FIG. 3 and the isolation characteristic of the conventional directional coupler illustrated in FIG. 2, the attenuation of the isolation characteristic is not increased by providing the low pass filter LPF1 in the directional coupler 10*a*.

Figure 5:
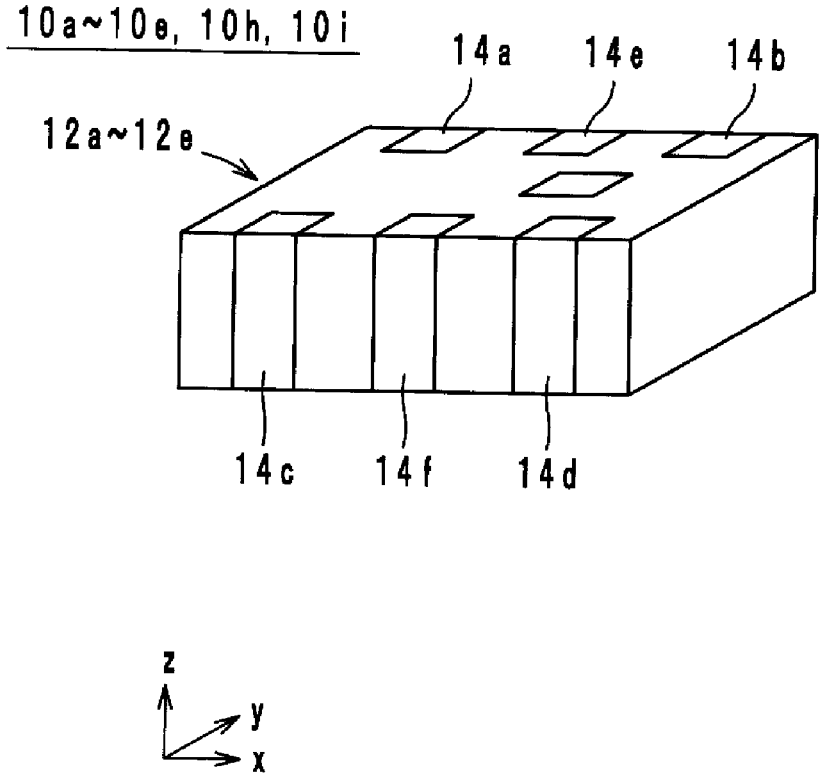
FIG. 5 is an external perspective view of a directional coupler according to any of first to fifth preferred embodiments of the present invention.
Figure 6:
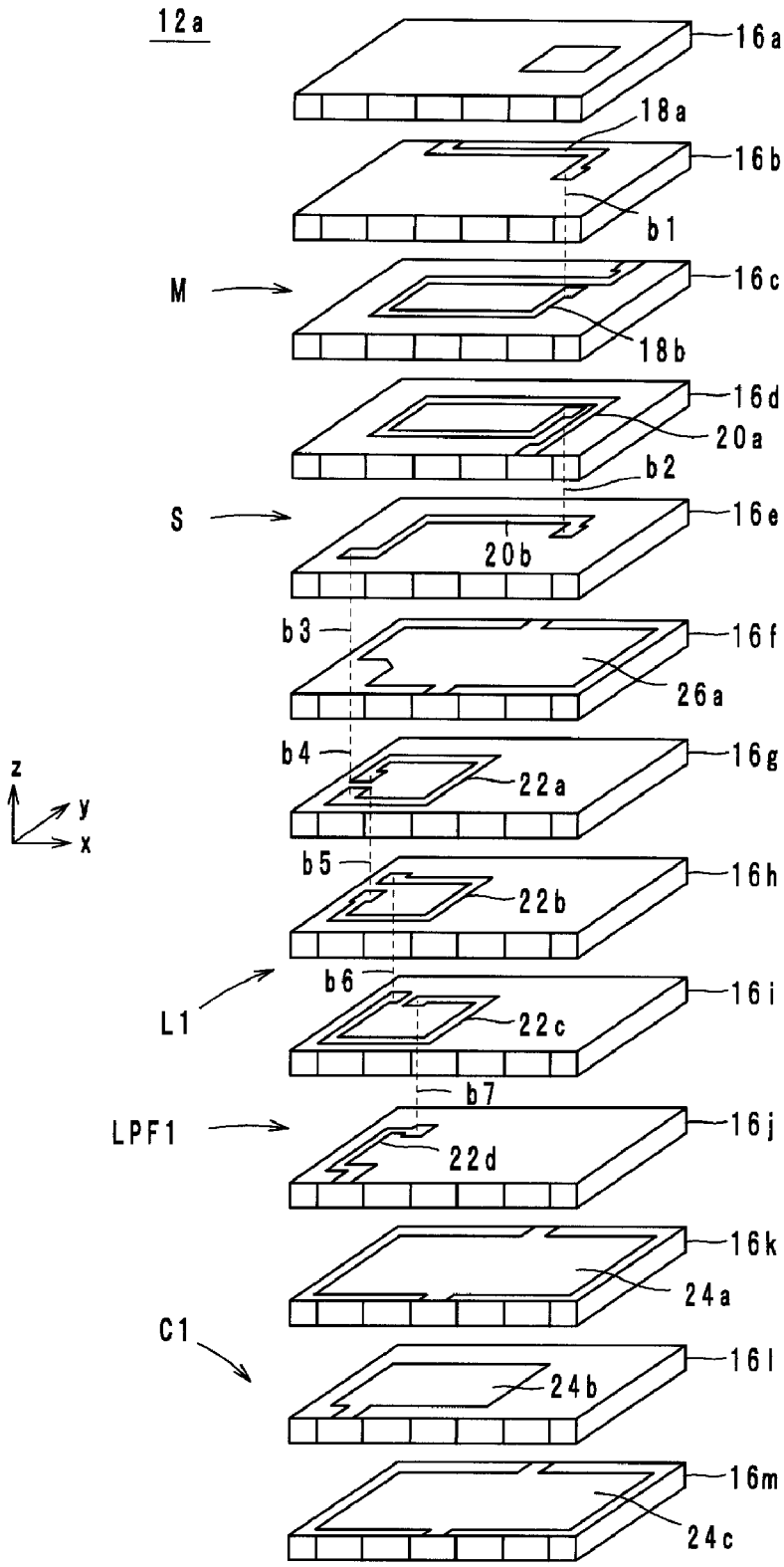
FIG. 6 is an exploded perspective view of a multilayer body of the directional coupler according to the first preferred embodiment of the present invention.

Next, a specific configuration of the directional coupler 10*a* will be described while referring to the drawings. FIG. 5 is an external perspective view of any of directional couplers 10*a* to 10*e* according to first to fifth preferred embodiments. FIG. 6 is an exploded perspective view of a multilayer body 12*a* of the directional coupler 10*a* according to the first preferred embodiment. Hereafter, the stacking direction is defined as a z-axis direction, a direction in which long sides of the directional coupler 10*a* extend when viewed in plan from the z-axis direction is defined as an x-axis direction and a direction in which short sides of the directional coupler 10*a* extend when viewed in plan from the z-axis direction is defined as a y-axis direction. The x axis, the y axis and the z axis are orthogonal to one another.

The directional coupler 10*a*, as illustrated in FIG. 5 and FIG. 6, preferably includes the multilayer body 12*a*, the outer electrodes 14 (14*a* to 14*f*), the main line M, the sub-line S, the low pass filter LPF1 and a shielding conductor layer 26*a*. The multilayer body 12*a*, as illustrated in FIG. 5, preferably has a rectangular parallelepiped shape, and, as illustrated in FIG. 6, is preferably formed by insulator layers 16 (16*a* to 16*m*) being stacked in this order from the positive side to the negative side in the z-axis direction, for example. The insulator layers 16 are dielectric ceramic layers having a rectangular or substantially rectangular shape, for example.

The outer electrodes 14*a*, 14*e* and 14*b* are provided on a lateral surface of the multilayer body 12*a* on the positive side in the y-axis direction so as to be adjacent to one another in this order from the negative side to the positive side in the x-axis direction. The outer electrodes 14*c*, 14*f* and 14*d* are provided on a lateral surface of the multilayer body 12*a* on the negative side in the y-axis direction so as to be adjacent to one another in this order from the negative side to the positive side in the x-axis direction.

The main line M, as illustrated in FIG. 6, preferably includes line portions 18 (18*a*, 18*b*) and a via hole conductor b1 and has a spiral shape that loops in the clockwise direction while advancing from the positive side to the negative side in the z-axis direction. Here, in the main line M, an end portion on the upstream side in the clockwise direction is termed an upstream end and an end portion on the downstream side in the clockwise direction is termed a downstream end. The line portion 18*a* is a line-shaped conductor layer that is provided on the insulator layer 16*b* and the upstream end thereof is connected to the outer electrode 14*a*. The line portion 18*b* is a line-shaped conductor layer that is provided on the insulator layer 16*c* and the downstream end thereof is connected to the outer electrode 14*b*. The via hole conductor b1 penetrates through the insulator layer 16*b* in the z-axis direction and connects the downstream end of the line portion 18*a* and the upstream end of the line portion 18*b* to each other. In this way, the main line M is connected between the outer electrodes 14*a* and 14*b*.

The sub-line S, as illustrated in FIG. 6, preferably includes line portions 20 (20*a*, 20*b*) and via hole conductors b2 to b4 and has a spiral shape that loops in the counterclockwise direction while advancing from the positive side to the negative side in the z-axis direction. In other words, the sub-line S loops in the opposite direction to the main line M. Furthermore, a region enclosed by the sub-line S is superposed with a region enclosed by the main line M when viewed in plan from the z-axis direction. That is, the main line M and the sub-line S oppose each other with the insulator layer 16*c* interposed therebetween. Thus, the main line M and the sub-line S are electromagnetically coupled with each other. Here, in the sub-line S, an end portion on the upstream side in the counterclockwise direction is termed an upstream end and an end portion on the downstream side in the counterclockwise direction is termed a downstream end. The line portion 20*a* is a line-shaped conductor layer that is provided on the insulator layer 16*d* and the upstream end thereof is connected to the outer electrode 14*d*. The line portion 20*b* is a line-shaped conductor layer that is provided on the insulator layer 16*e*. The via hole conductor b2 penetrates through the insulator layer 16*d* in the z-axis direction and connects the downstream end of the line portion 20*a* and the upstream end of the line portion 20*b* to each other. In addition, the via hole conductors b3 and b4 penetrate through the insulator layers 16*e* and 16*f* in the z-axis direction and are connected to each other. The via hole conductor b3 is connected to the downstream end of the line portion 20*b*.

The low pass filter LPF1 preferably includes the coil L1 and the capacitor C1. The coil L1 includes line portions 22 (22*a* to 22*d*) and via hole conductors b5 to b7 and has a spiral shape that loops in the counterclockwise direction while advancing from the positive side to the negative side in the z-axis direction. Here, in the coil L1, an end portion on the upstream side in the counterclockwise direction is termed an upstream end and an end portion on the downstream side in the counterclockwise direction is termed a downstream end. The line portion 22*a* is a line-shaped conductor layer that is provided on the insulator layer 16*g* and the upstream end thereof is connected to the via hole conductor b4. The line portions 22*b* and 22*c* are line-shaped conductor layers that are provided on the insulator layers 16*h* and 16*i*, respectively. The line portion 22*d* is a line-shaped conductor layer that is provided on the insulator layer 16*j* and the downstream end thereof is connected to the outer electrode 14*c*. The via hole conductor b5 penetrates through the insulator layer 16*g* in the z-axis direction and connects the downstream end of the line portion 22*a* and the upstream end of the line portion 22*b* to each other. The via hole conductor b6 penetrates through the insulator layer 16*h* in the z-axis direction and connects the downstream end of the line portion 22*b* and the upstream end of the line portion 22*c* to each other. The via hole conductor b7 penetrates through the insulator layer 16*i* in the z-axis direction and connects the downstream end of the line portion 22*c* and the upstream end of the line portion 22*d* to each other. In this way, the coil L1 is connected between the sub-line S and the outer electrode 14*c*.

The capacitor C1 preferably includes planar conductor layers 24 (24*a* to 24*c*). The planar conductor layers 24*a* and 24*c* are respectively provided so as to cover substantially the entire surfaces of the insulator layers 16*k* and 16*m* and are connected to the outer electrodes 14*e* and 14*f*. The planar conductor layer 24*b* is provided on the insulator layer 16*l* and is connected to the outer electrode 14*c*. The planar conductor layer 24*b* preferably has a rectangular or substantially rectangular shape and is superposed with the planar conductor layers 24*a* and 24*c* when viewed in plan from the z-axis direction. In this way, a capacitance is generated between the planar conductor layers 24*a* and 24*c* and the planar conductor layer 24*b*. The capacitor C1 is connected between the outer electrode 14*c* and the outer electrodes 14*e* and 14*f*. That is, the capacitor C1 is connected between a point between the coil L1 and the outer electrode 14*c*, and the outer electrodes 14*e* and 14*f*.

The shielding conductor layer 26*a* is arranged so as to cover substantially the entire surface of the insulator layer 16*f* and is connected to the outer electrodes 14*e* and 14*f*. That is, a ground potential is applied to the shielding conductor layer 26*a*. The shielding conductor layer 26*a* is provided between the main line M and the sub-line S, and the coil L1 in the z-axis direction such that electromagnetic coupling between the sub-line S and the coil L1 is prevented and suppressed.

Second Preferred Embodiment

Figure 7:
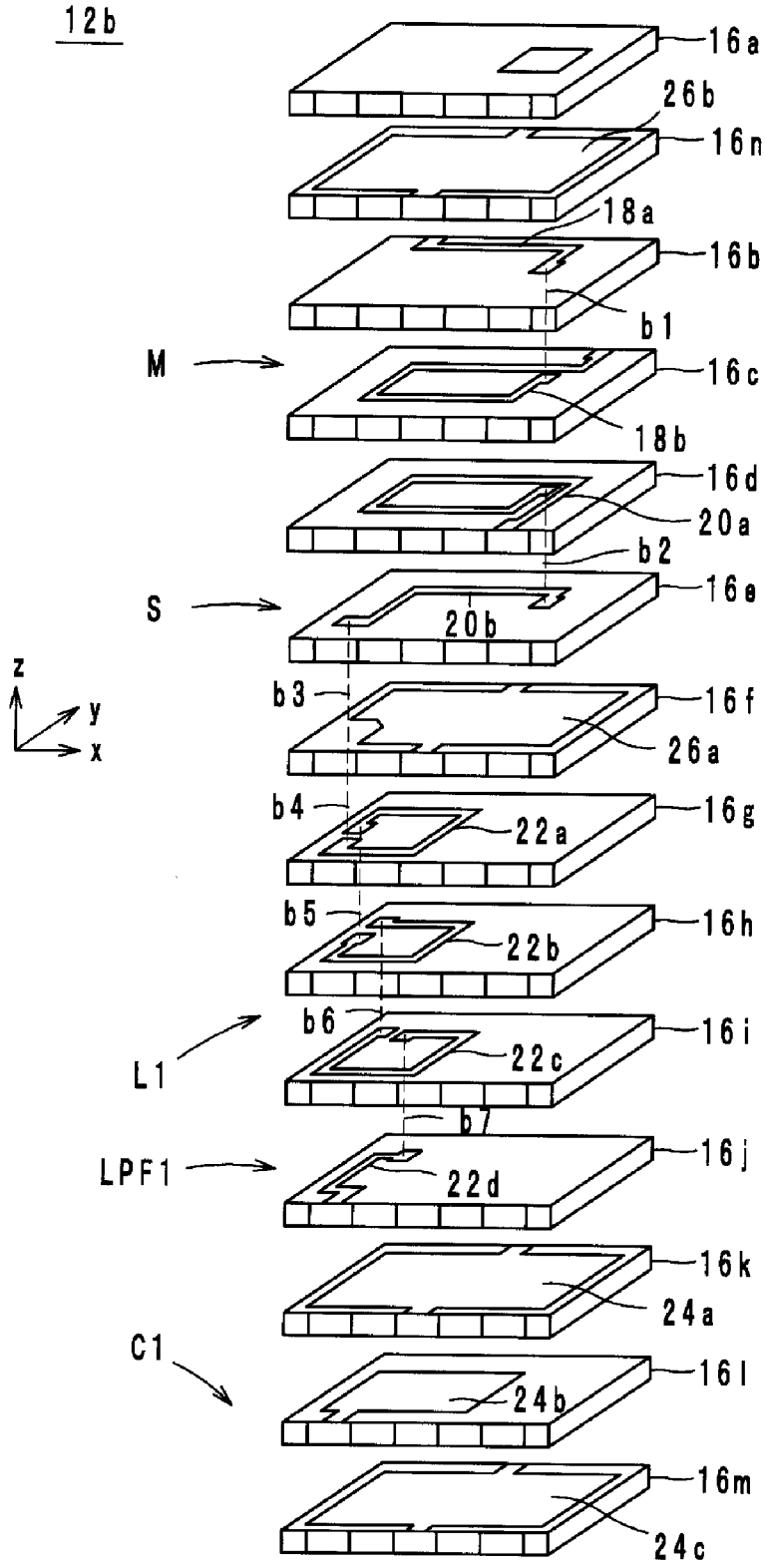
FIG. 7 is an exploded perspective view of a multilayer body of the directional coupler according to the second preferred embodiment of the present invention.

Hereafter, the configuration of a directional coupler 10*b* according to a second preferred embodiment will be described while referring to the drawings. FIG. 7 is an exploded perspective view of a multilayer body 12*b* of the directional coupler 10*b* according to the second preferred embodiment.

The circuit configuration of the directional coupler 10*b* preferably is the same as that of the directional coupler 10*a* and therefore description thereof will be omitted. A difference between the directional coupler 10*b* and the directional coupler 10*a* is that, as illustrated in FIG. 7, an insulator layer 16*n*, on which a shielding conductor layer 26*b* is provided, is provided between the insulator layers 16*a* and 16*b*.

More specifically, the shielding conductor layer 26*b* is provided so as to cover substantially the entire surface of the insulator layer 16*n* and is connected to the outer electrodes 14*e* and 14*f*. That is, a ground potential is applied to the shielding conductor layer 26*b*. The shielding conductor layer 26*b* is provided on the positive side of the main line M in the z-axis direction. In this way, the shielding conductor layer 26*b* is arranged such that the main line M, the sub-line S and the coil L1 are interposed between the shielding conductor layer 26*b* and the planar conductor layers 24*a* and 24*c* in the z-axis direction. Thus, leakage of magnetic fields generated by the main line M, the sub-line S and the coil L1 to outside of the multilayer body 12*b* is prevented by the shielding conductor layer 26*b* and the planar conductor layers 24*a* and 24*c*.

Third Preferred Embodiment

Figure 8:
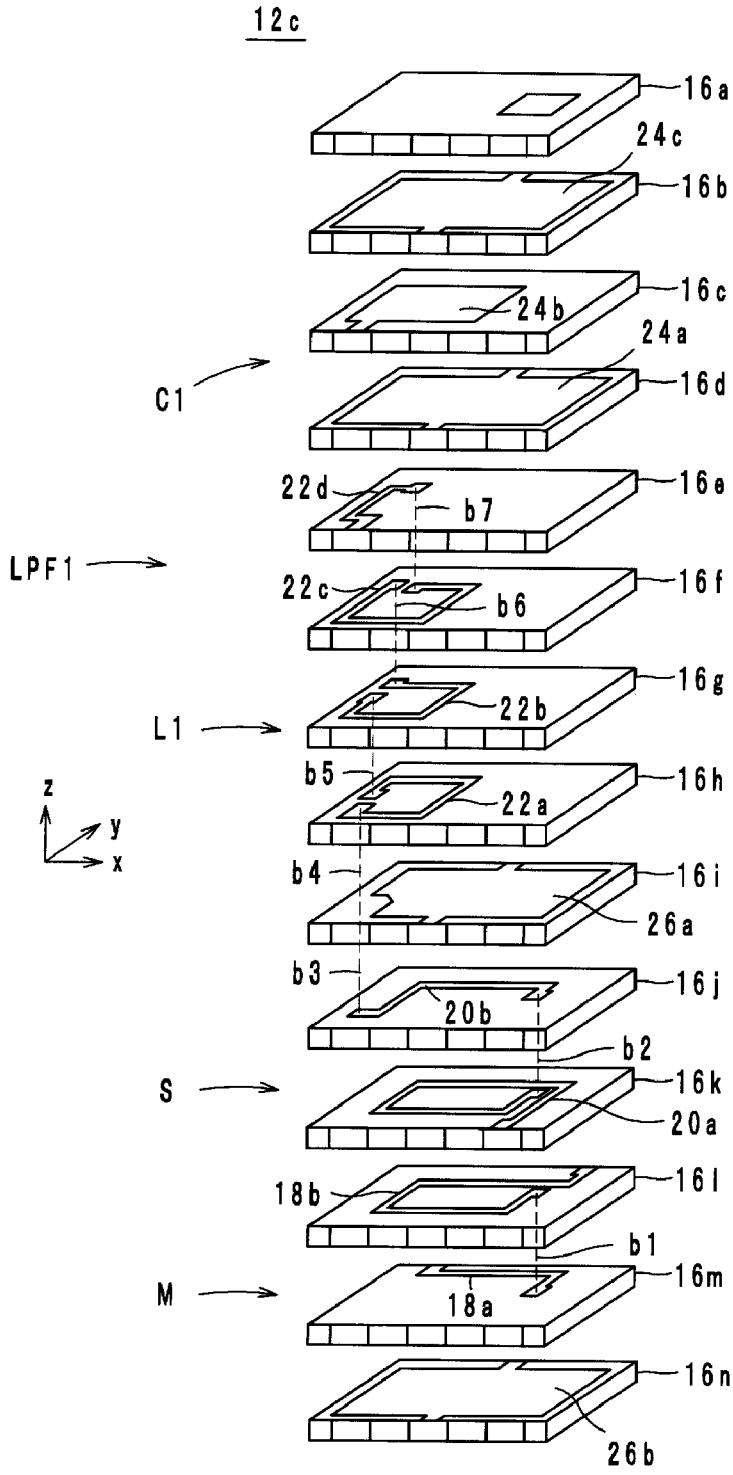
FIG. 8 is an exploded perspective view of a multilayer body of the directional coupler according to the third preferred embodiment of the present invention.

Hereafter, the configuration of a directional coupler 10*c* according to a third preferred embodiment will be described while referring to the drawings. FIG. 8 is an exploded perspective view of a multilayer body 12*c* of the directional coupler 10*c* according to the third preferred embodiment.

The circuit configuration of the directional coupler 10*c* preferably is the same as that of the directional couplers 10*a* and 10*b* and therefore description thereof will be omitted. A difference between the directional coupler 10*c* and the directional coupler 10*b* is that the order in which the main line M, the sub-line S, the low pass filter LPF1 (coil L1 and capacitor C1), and the shielding conductor layers 26*a* and 26*b* are stacked is different.

More specifically, in the directional coupler 10*b*, as illustrated in FIG. 7, the shielding conductor layer 26*b*, the main line M, the sub-line S, the shielding conductor layer 26*a*, the coil L1 and the capacitor C1 are arranged in this order from the positive side to the negative side in the z-axis direction. In contrast, in the directional coupler 10*c*, as illustrated in FIG. 8, the capacitor C1, the coil L1, the shielding conductor layer 26*a*, the sub-line S, the main line M and the shielding conductor layer 26*b* are arranged in this order from the positive side to the negative side in the z-axis direction.

With the directional coupler 10*c* having the above-described configuration, it is also possible to make the degree of coupling characteristic close to being constant while preventing the magnetic fields generated by the main line M, the sub-line S and the coil L1 from leaking to the outside, similarly to the directional coupler 10*b*.

Fourth Preferred Embodiment

Figure 9:
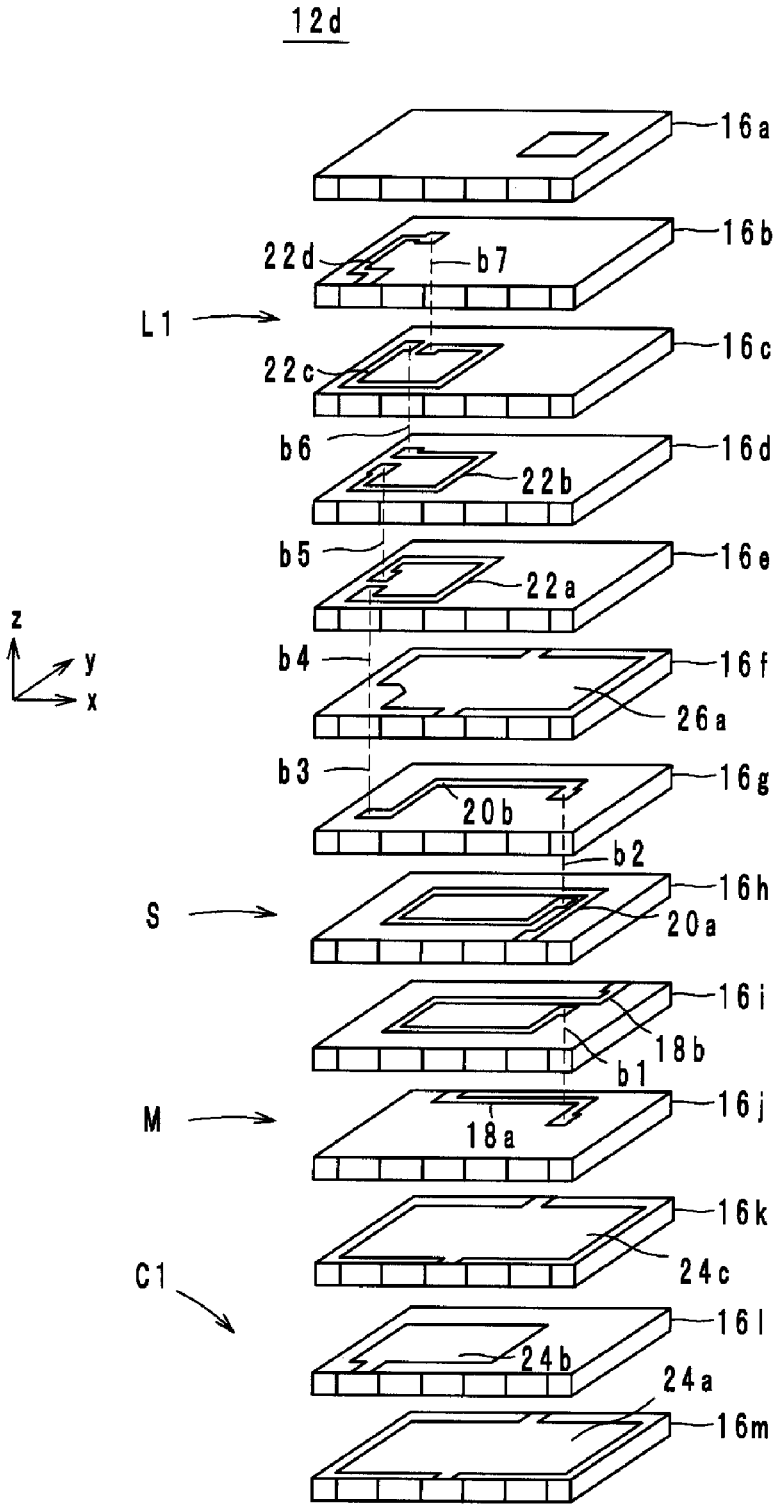
FIG. 9 is an exploded perspective view of a multilayer body of the directional coupler according to the fourth preferred embodiment of the present invention.

Hereafter, the configuration of a directional coupler 10*d* according to a fourth preferred embodiment will be described while referring to the drawings. FIG. 9 is an exploded perspective view of a multilayer body 12*d* of the directional coupler 10*d* according to the fourth preferred embodiment.

The circuit configuration of the directional coupler 10*d* preferably is the same as that of the directional couplers 10*a* and 10*b* and therefore description thereof will be omitted. A difference between the directional coupler 10*d* and the directional coupler 10*a* is that the order in which the main line M, the sub-line S, the low pass filter LPF1 (coil L1 and capacitor C1), and the shielding conductor layer 26*a* are stacked is different.

More specifically, in the directional coupler 10*a*, as illustrated in FIG. 6, the main line M, the sub-line S, the shielding conductor layer 26*a*, the coil L1 and the capacitor C1 are arranged in this order from the positive side to the negative side in the z-axis direction. In contrast, in the directional coupler 10*d*, as illustrated in FIG. 9, the coil L1, the shielding conductor layer 26*a*, the sub-line S, the main line M and the capacitor C1 are arranged in this order from the positive side to the negative side in the z-axis direction.

With the directional coupler 10*d* having the above-described configuration, it is also possible to make the degree of coupling characteristic close to constant, similarly to the directional coupler 10*a*.

In addition, in the directional coupler 10*d*, the capacitor C1 is provided on the negative side of the main line M and the sub-line S in the z-axis direction. Thus, the main line M and the sub-line S are interposed between the planar conductor layers 24*a* and 24*c*, and the shielding conductor layer 26*a* in the z-axis direction. Therefore, leaking of the magnetic fields generated by the main line M and the sub-line S to outside of the multilayer body 12*d* is prevented by the planar conductor layers 24*a* and 24*c* and the shielding conductor layer 26*a*. That is, in the directional coupler 10*d*, there is no need to additionally provide another shielding conductor layer 26 to prevent leaking of the magnetic fields generated by the main line M and the sub-line S to outside of the multilayer body 12*d*.

Fifth Preferred Embodiment

Figure 10:
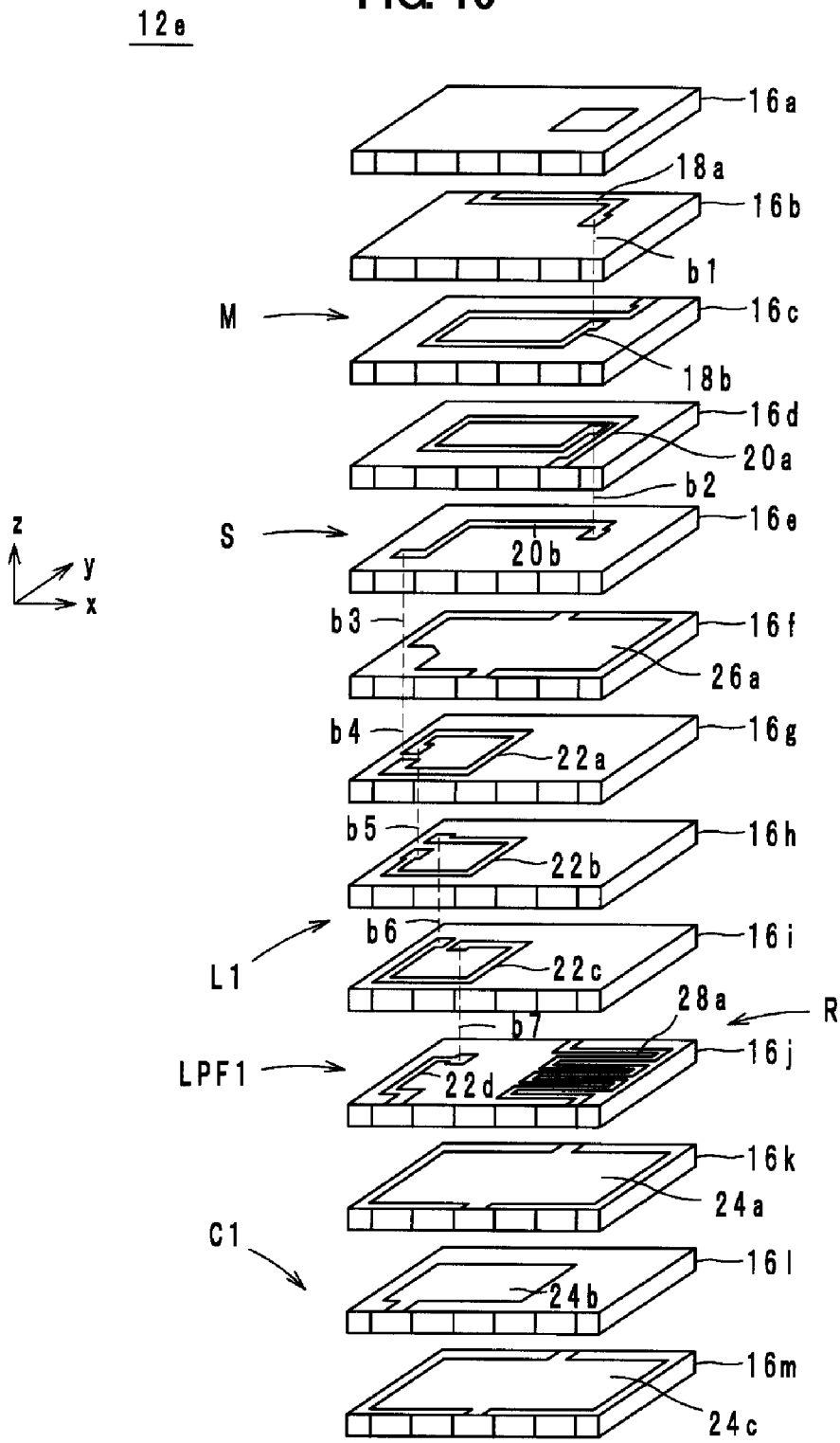
FIG. 10 is an exploded perspective view of a multilayer body of the directional coupler according to the fifth preferred embodiment of the present invention.

Hereafter, the configuration of a directional coupler 10*e* according to a fifth preferred embodiment will be described while referring to the drawings. FIG. 10 is an exploded perspective view of a multilayer body 12*e* of the directional coupler 10*e* according to the fifth preferred embodiment.

The directional coupler 10*e* preferably has a circuit configuration in which a termination resistor R, which is provided to terminate the outer electrode 14*d*, is additionally provided between the outer electrode 14*d* and the outer electrode 14*e* in the circuit configuration of the directional coupler 10*a* illustrated in FIG. 1. In the directional coupler 10*e*, as illustrated in FIG. 10, a resistance conductor layer 28*a*, which serves as the termination resistor R, is provided on the insulator layer 16*j*.

More specifically, the resistance conductor layer 28*a*, as illustrated in FIG. 10, is a meandering line-shaped conductor layer that is connected between the outer electrode 14*d* and the outer electrode 14*e*. The resistance conductor layer 28*a*, for example, has an impedance of about 50Ω. Thus, it is also possible to build the termination resistor R into the directional coupler 10*e*. In this case, compared with when the termination resistor is provided on the outside, the substrate on which this directional coupler is to be mounted can be reduced in size by the amount of space that would have been taken up by the termination resistor.

Sixth Preferred Embodiment

Figure 11:
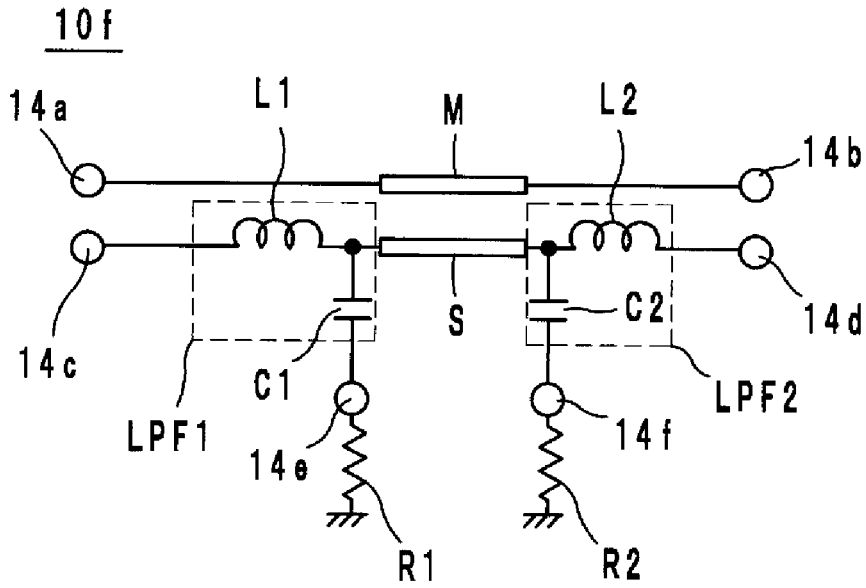
FIG. 11 is an equivalent circuit diagram of a directional coupler according to a sixth preferred embodiment of the present invention.

Hereafter, a directional coupler according to a sixth preferred embodiment will be described while referring to the drawings. FIG. 11 is an equivalent circuit diagram of a directional coupler 10*f* according to the sixth preferred embodiment.

The circuit configuration of the directional coupler 10*f* will now be described. The configuration of the low pass filter LPF1 of the directional coupler 10*f* is different from the configuration of the low pass filter LPF1 of the directional coupler 10*a*. Specifically, in the low pass filter LPF1 of the directional coupler 10*a*, the capacitor C1 is connected between a point between the outer electrode 14*c* and the coil L1, and the outer electrodes 14*e* and 14*f*, as illustrated in FIG.

1. In contrast, in the low pass filter LPF1 of the directional coupler 10*f*, the capacitor C1 is connected between a point between the sub-line S and the coil L1, and the outer electrode 14*e*, as illustrated in FIG. 11. Thus, an unwanted signal, among signals output to the outer electrode 14*c* side from the sub-line S, is output to outside of the directional coupler 10*f* via the capacitor C1 and the outer electrode 14*e*, without passing through the coil L1. Consequently, returning of such an unwanted signal to the sub-line S side after being reflected by the coil L1 is prevented.

In addition, in the directional coupler 10*f*, a low pass filter LPF2 is additionally provided to the configuration of the directional coupler 10*a*. Specifically, the low pass filter LPF2 is connected between the outer electrode 14*d* and the sub-line S and has a characteristic that attenuation increases with increasing frequency. The low pass filter LPF2 includes a capacitor C2 and a coil L2. The coil L2 is connected in series between the outer electrode 14*d* and the sub-line S. The capacitor C2 is connected between a point between the sub-line S and the outer electrode 14*d* (more precisely a point between the coil L2 and the sub-line S), and the outer electrode 14*f*.

The above-described directional coupler 10*f* can use both the outer electrodes 14*c* and 14*d* as coupling ports. More specifically, in a first method of using the directional coupler 10*f*, similarly to as with the directional coupler 10*a*, the outer electrode 14*a* is used as an input port and the outer electrode 14*b* is used as an output port. The outer electrode 14*c* is used as a coupling port and the outer electrode 14*d* is used as a termination port. The outer electrodes 14*e* and 14*f* are used as termination ports. In this case, when a signal is input to the outer electrode 14*a*, the signal is output from the outer electrode 14*b*. Furthermore, since the main line M and the sub-line S are electromagnetically coupled with each other, a signal having a power that is proportional to the power of the input signal is output from the outer electrode 14*c*.

In addition, in a second method of using the directional coupler 10*f*, the outer electrode 14*b* is used as an input port and the outer electrode 14*a* is used as an output port. The outer electrode 14*d* is used as a coupling port and the outer electrode 14*c* is used as a termination port. The outer electrodes 14*e* and 14*f* are used as termination ports. In this case, when a signal is input to the outer electrode 14*b*, the signal is output from the outer electrode 14*a*. Furthermore, since the main line M and the sub-line S are electromagnetically coupled with each other, a signal having a power that is proportional to the power of the input signal is output from the outer electrode 14*d*.

The above-described directional coupler 10*f*, for example, can be applied to transmission and reception circuits of wireless communication terminals such as cellular phones. That is, when detecting the power of a transmission signal, 14*a* may serve as an input port and when detecting the power of reflection from an antenna, the outer electrode 14*b* may serve as an input port. In the directional coupler 10*f*, even though either of the outer electrodes 14*a* and 14*b* may be used as an input port, since the low pass filters LPF1 and LPF2 are provided, it is possible to make the degree of coupling characteristic close to constant.

In addition, in the directional coupler 10*f*, termination resistors R1 and R2 are connected between the outer electrodes 14*g* and 14*h* and the ground potential. Thus, the occurrence of reflection of signals from the outer electrodes 14*g* and 14*h* toward the outer electrodes 14*c* and 14*d* via the low pass filters LPF1 and LPF2 is prevented and suppressed.

Figure 12:
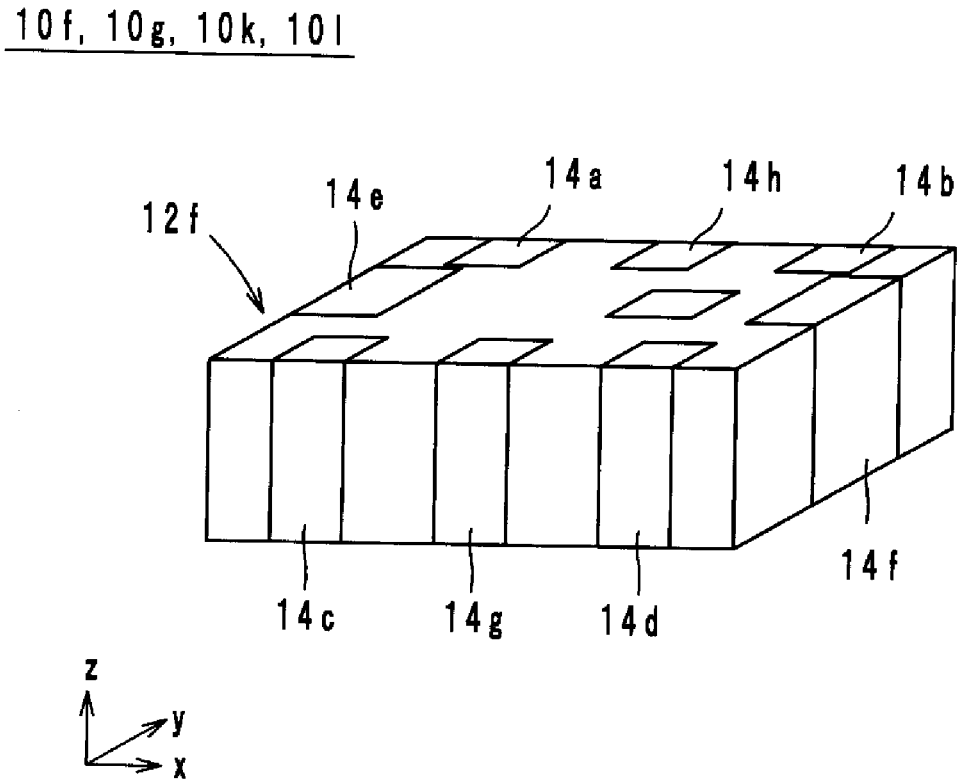
FIG. 12 is an external perspective view of a directional coupler according to the sixth or a seventh preferred embodiment of the present invention.
Figure 13:
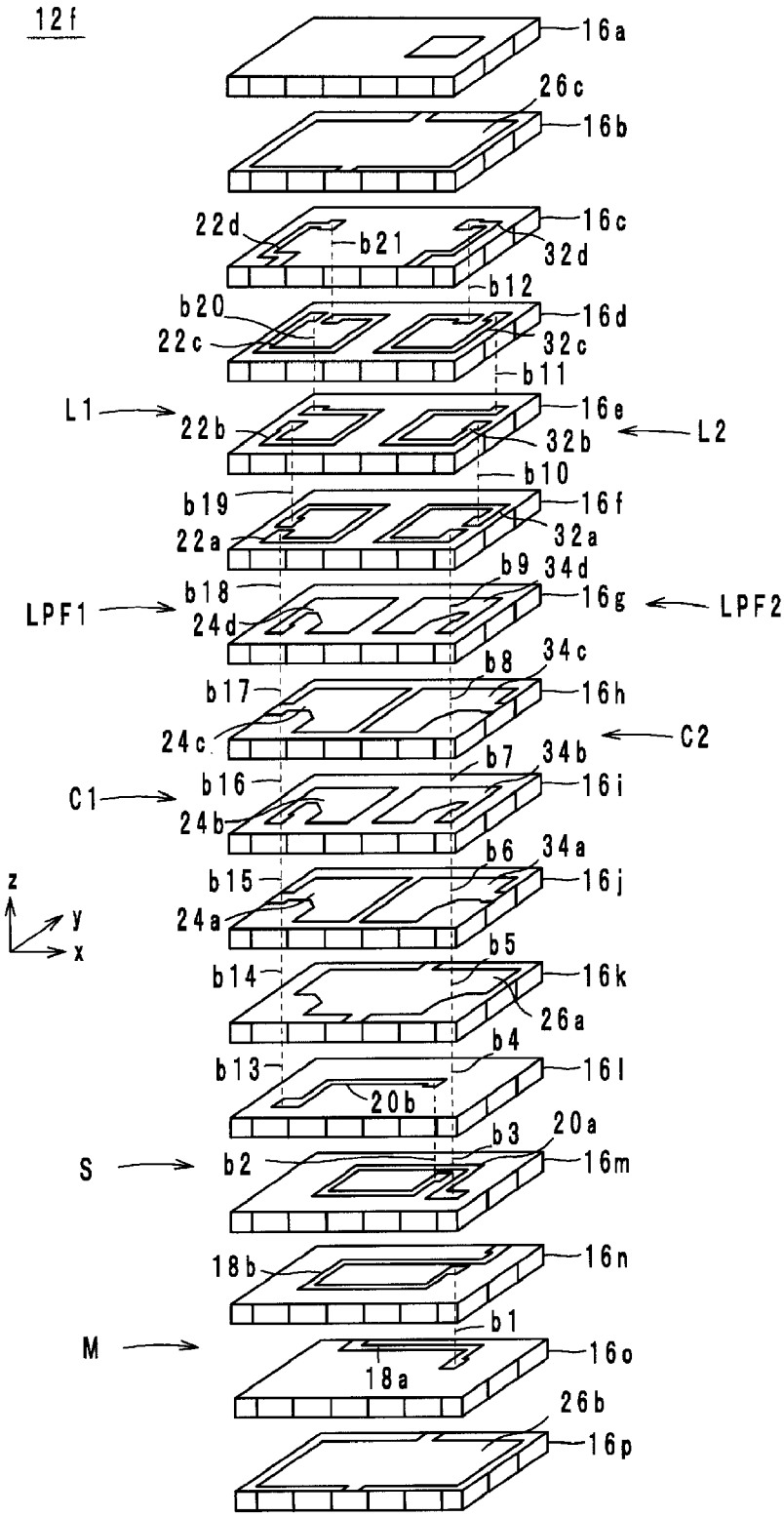
FIG. 13 is an exploded perspective view of a multilayer body of the directional coupler according to the sixth preferred embodiment of the present invention.

Next, a specific configuration of the directional coupler 10*f* will be described while referring to the drawings. FIG. 12 is an external perspective view of either of directional couplers 10*f* and 10*g* according to the sixth preferred embodiment and a seventh preferred embodiment. FIG. 13 is an exploded perspective view of a multilayer body 12*f* of the directional coupler 10*f* according to the sixth preferred embodiment. Hereafter, the stacking direction is defined as a z-axis direction, a direction in which long sides of the directional coupler 10*f* extend when viewed in plan from the z-axis direction is defined as an x-axis direction and a direction in which short sides of the directional coupler 10*f* extend when viewed in plan from the z-axis direction is defined as a y-axis direction. The x axis, the y axis and the z axis are orthogonal to one another.

The directional coupler 10*f*, as illustrated in FIG. 12 and FIG. 13, includes the multilayer body 12*f*, the outer electrodes 14 (14*a* to 14*h*), the main line M, the sub-line S, the low pass filters LPF1 and LPF2 and shielding conductor layers 26 (26*a* to 26*c*). The multilayer body 12*f*, as illustrated in FIG. 12, preferably has a rectangular parallelepiped shape, and, as illustrated in FIG. 13, and preferably is formed by insulator layers 16 (16*a* to 16*p*) being stacked in this order from the positive side to the negative side in the z-axis direction. The insulator layers 16 preferably are dielectric ceramic layers having a rectangular or substantially rectangular shape, for example.

The outer electrodes 14*a*, 14*h* and 14*b* are provided on a lateral surface of the multilayer body 12*f* on the positive side in the y-axis direction so as to be adjacent to one another in this order from the negative side to the positive side in the x-axis direction. The outer electrodes 14*c*, 14*g* and 14*d* are provided on a lateral surface of the multilayer body 12*f* on the negative side in the y-axis direction so as to be adjacent to one another in this order from the negative side to the positive side in the x-axis direction. The outer electrode 14*e* is provided on a lateral surface of the multilayer body 12*f* on the negative side in the x-axis direction. The outer electrode 14*f* is provided on a lateral surface of the multilayer body 12*f* on the positive side in the x-axis direction.

The main line M, as illustrated in FIG. 13, preferably includes the line portions 18 (18*a*, 18*b*) and the via hole conductor b1 and has a spiral shape that loops in the counterclockwise direction while advancing from the positive side to the negative side in the z-axis direction. Here, in the main line M, an end portion on the upstream side in the counterclockwise direction is termed an upstream end and an end portion on the downstream side in the counterclockwise direction is termed a downstream end. The line portion 18*a* is a line-shaped conductor layer that is provided on the insulator layer 16*o* and the downstream end thereof is connected to the outer electrode 14*a*. The line portion 18*b* is a line-shaped conductor layer that is provided on the insulator layer 16*n* and the upstream end thereof is connected to the outer electrode 14*b*. The via hole conductor b1 penetrates through the insulator layer 16*n* in the z-axis direction and connects the upstream end of the line portion 18*a* and the downstream end of the line portion 18*b* to each other. In this way, the main line M is connected between the outer electrodes 14*a* and 14*b*.

The sub-line S, as illustrated in FIG. 13, preferably includes the line portions 20 (20*a*, 20*b*) and via hole conductors b2 to b6 and b13 to b15 and has a spiral shape that loops in the clockwise direction while advancing from the positive side to the negative side in the z-axis direction. In other words, the sub-line S loops in the opposite direction to the main line M. Furthermore, a region enclosed by the sub-line S is superposed with a region enclosed by the main line M when viewed in plan from the z-axis direction. That is, the main line M and the sub-line S oppose each other with the insulator layer 16*m* therebetween. Thus, the main line M and the sub-line S are electromagnetically coupled with each other. Here, in the sub-line S, an end portion on the upstream side in the clockwise direction is termed an upstream end and an end portion on the downstream side in the clockwise direction is termed a downstream end. The line portion 20*a* is a line-shaped conductor layer that is provided on the insulator layer 16*m*. The line portion 20*b* is a line-shaped conductor layer that is provided on the insulator layer 16*l*. The via hole conductor b2 penetrates through the insulator layer 16*l* in the z-axis direction and connects the upstream end of the line portion 20*a* and the downstream end of the line portion 20*b* to each other. In addition, the via hole conductors b3, b4, b5 and b6 respectively penetrate through the insulator layers 16*l*, 16*k*, 16*j* and 16*i* in the z-axis direction and are connected to one another. The via hole conductor b3 is connected to the downstream end of the line portion 20*a*. In addition, the via hole conductors b13, b14 and b15 respectively penetrate through the insulator layers 16*k*, 16*j* and 16*i* in the z-axis direction and are connected to one another. The via hole conductor b13 is connected to the upstream end of the line portion 20*b*.

The low pass filter LPF1 preferably includes the coil L1 and the capacitor C1. The capacitor C1 preferably includes the planar conductor layers 24 (24*a* to 24*d*) and via hole conductors b16 and b17. The planar conductor layers 24*a* and 24*c* preferably are rectangular-shaped conductor layers that are respectively provided on the insulator layers 16*j* and 16*h* and are connected to the outer electrode 14*e*. The planar conductor layers 24*b* and 24*d* are provided on the insulator layers 16*i* and 16*g*. The planar conductor layers 24*b* and 24*d* preferably have a rectangular or substantially rectangular shape and are superposed with the planar conductor layers 24*a* and 24*c* when viewed in plan from the z-axis direction. In this way, a capacitance is generated between the planar conductor layers 24*a* and 24*c* and the planar conductor layers 24*b* and 24*d*. The via hole conductors b16 and b17 respectively penetrate through the insulator layers 16*h* and 16*g* and are connected to each other. The via hole conductors b16 and b17 connect the planar conductor layers 24*b* and 24*d* to each other. In addition, the via hole conductor b15 is connected to the planar conductor layer 24*b*. In this way, the capacitor C1 is connected to the upstream end of the sub-line S.

The coil L1 preferably includes the line portions (22*a* to 22*d*) and the via hole conductors b18 to b21 and has a spiral shape that loops in the clockwise direction while advancing from the positive side to the negative side in the z-axis direction. Here, in the coil L1, an end portion on the upstream side in the clockwise direction is termed an upstream end and an end portion on the downstream side in the clockwise direction is termed a downstream end. The line portions 22*a*, 22*b* and 22*c* are line-shaped conductor layers that are provided on the insulator layers 16*f*, 16*e* and 16*d*, respectively. The line portion 22*d* is a line-shaped conductor layer that is provided on the insulator layer 16*c* and the upstream end thereof is connected to the outer electrode 14*c*. The via hole conductor b18 penetrates through the insulator layer 16*f* in the z-axis direction and connects the downstream end of the line portion 22*a* and the planar conductor layer 24*d* to each other. The via hole conductor b19 penetrates through the insulator layer 16*e* in the z-axis direction and connects the upstream end of the line portion 22*a* and the downstream end of the line portion 22*b* to each other. The via hole conductor b20 penetrates through the insulator layer 16*d* in the z-axis direction and connects the upstream end of the line portion 22*b* and the downstream end of the line portion 22*c* to each other. The via hole conductor b21 penetrates through the insulator layer 16*c* in the z-axis direction and connects the upstream end of the line portion 22*c* and the downstream end of the line portion 22*d* to each other. In this way, the coil L1 is connected between the capacitor C1 and the sub-line S and the outer electrode 14*c*.

The low pass filter LPF2 preferably includes the coil L2 and the capacitor C2. The capacitor C2 preferably includes planar conductor layers 34 (34*a* to 34*d*) and the via hole conductors b7 and b8. The planar conductor layers 34*a* and 34*c* preferably are rectangular-shaped conductor layers that are respectively provided on the insulator layers 16*j* and 16*h* and connected to the outer electrode 14*f*. The planar conductor layers 34*b* and 34*d* are provided on the insulator layers 16*i* and 16*g*. The planar conductor layers 34*b* and 34*d* preferably have a rectangular or substantially rectangular shape and are superposed with the planar conductor layers 34*a* and 34*c* when viewed in plan from the z-axis direction. In this way, a capacitance is generated between the planar conductor layers 34*a* and 34*c* and the planar conductor layers 34*b* and 34*d*. The via hole conductors b7 and b8 respectively penetrate through the insulator layers 16*h* and 16*g* and are connected to each other. The via hole conductors b7 and b8 connect the planar conductor layers 34*b* and 34*d* to each other. In addition, the via hole conductor b6 is connected to the planar conductor layer 34*b*. In this way, the capacitor C2 is connected to the downstream end of the sub-line S.

The coil L2 preferably includes line portions 32 (32*a* to 32*d*) and via hole conductors b9 to b12 and has a spiral shape that loops in the counterclockwise direction while advancing from the positive side to the negative side in the z-axis direction. Here, in the coil L2, an end portion on the upstream side in the counterclockwise direction is termed an upstream end and an end portion on the downstream side in the counterclockwise direction is termed a downstream end. The line portions 32*a*, 32*b* and 32*c* are line-shaped conductor layers that are provided on the insulator layers 16*f*, 16*e* and 16*d*, respectively. The line portion 32*d* is a line-shaped conductor layer that is provided on the insulator layer 16*c* and the upstream end thereof is connected to the outer electrode 14*d*. The via hole conductor b9 penetrates through the insulator layer 16*f* in the z-axis direction and connects the downstream end of the line portion 32*a* and the planar conductor layer 34*d* to each other. The via hole conductor b10 penetrates through the insulator layer 16*e* in the z-axis direction and connects the upstream end of the line portion 32*a* and the downstream end of the line portion 32*b* to each other. The via hole conductor b11 penetrates through the insulator layer 16*d* in the z-axis direction and connects the upstream end of the line portion 32*b* and the downstream end of the line portion 32*c* to each other. The via hole conductor b12 penetrates through the insulator layer 16*c* in the z-axis direction and connects the upstream end of the line portion 32*c* and the downstream end of the line portion 32*d* to each other. In this way, the coil L2 is connected between the capacitor C2 and the sub-line S and the outer electrode 14*c*.

The shielding conductor layer 26*a* is arranged so as to cover substantially the entire surface of the insulator layer 16*k* and is connected to the outer electrodes 14*g* and 14*h*. That is, a ground potential is applied to the shielding conductor layer 26*a*. The shielding conductor layer 26*a* is provided between the sub-line S and the capacitors C1 and C2 and suppresses electromagnetic coupling between the sub-line S and the capacitors C1 and C2.

The shielding conductor layers 26*b* and 26*c* are arranged so as to cover substantially the entire surfaces of the insulator layers 16*p* and 16*b* and are connected to the outer electrodes 14*g* and 14*h*. That is, a ground potential is applied to the shielding conductor layers 26*b* and 26*c*. The shielding conductor layer 26*b* is provided on the negative side of the main line M and the sub-line S in the z-axis direction. In addition, the shielding conductor layer 26*c* is provided on the positive side of the coils L1 and L2 in the z-axis direction. Thus, as for the shielding conductor layers 26*b* and 26*c*, leaking of the magnetic fields generated by the main line M, the sub-line S and the coils L1 and L2 to outside of the multilayer body 12*f* is prevented by the shielding conductor layer 26*b*. Furthermore, since the coils L1 and L2 preferably have spiral shapes that loop in opposite directions to each other, the magnetic fields generated between these two coils flow in opposite directions and coupling of magnetic fields between the coils can be prevented and suppressed. Thus, coupling between coupling ports and termination ports can be prevented and suppressed and isolation characteristics can be improved.

Seventh Preferred Embodiment

Figure 14:
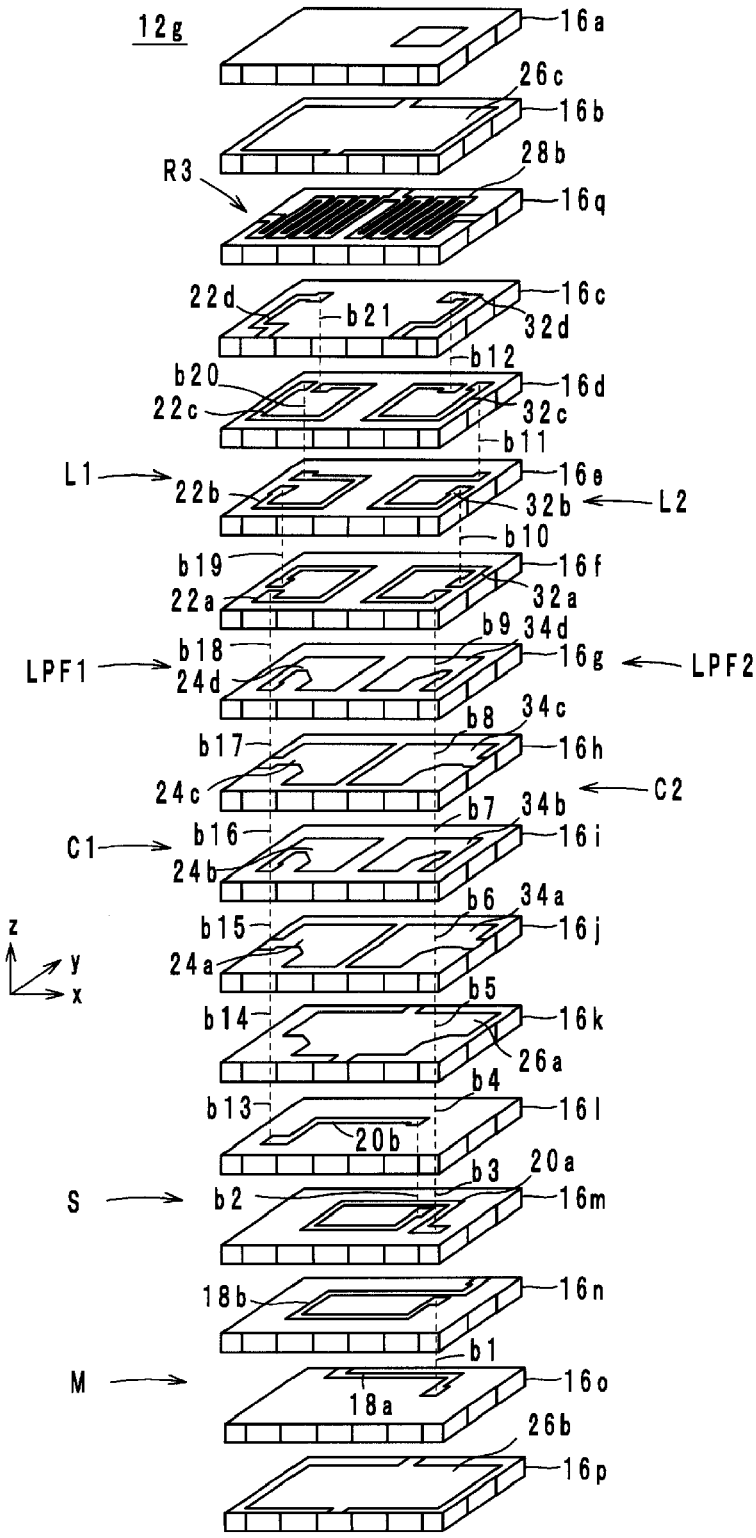
FIG. 14 is an exploded perspective view of a multilayer body of the directional coupler according to the seventh preferred embodiment of the present invention.

Hereafter, the configuration of a directional coupler 10*g* according to a seventh preferred embodiment will be described while referring to the drawings. FIG. 14 is an exploded perspective view of a multilayer body 12*g* of the directional coupler 10*g* according to the seventh preferred embodiment.

In the directional coupler 10*g*, a termination resistor R3, which is provided to terminate the outer electrodes 14*e* and 14*f*, is connected between the outer electrodes 14*e* and 14*h* and between the outer electrodes 14*f* and 14*h*, so as to replace the termination resistors R1 and R2 in the circuit configuration of the directional coupler 10*f* illustrated in FIG. 11. Thus, the capacitor C1 is connected between a point between the outer electrode 14*c* and the sub-line S (more precisely a point between the coil L1 and the sub-line S), and the termination resistor R3. Furthermore, the capacitor C2 is connected between a point between the outer electrode 14*d* and the sub-line S (more precisely between the coil L2 and the sub-line S), and the termination resistor R3. A potential such as a ground potential or the like is not applied to the outer electrodes 14*e* and 14*f*. On the other hand, the outer electrode 14*h* is used as a grounding terminal to which a ground potential is applied. In order to satisfy the above-described configuration, in the directional coupler 10*g*, as illustrated in FIG. 14, an insulator layer 16*q* is provided, on which a resistance conductor layer 28*b* is provided as the termination resistor R3.

More specifically, the resistance conductor layer 28*b*, as illustrated in FIG. 14, is arranged so as to be connected between the outer electrodes 14*e* and 14*h* and between the outer electrodes 14*f* and 14*h* and is a conductor layer having a meandering shape. The resistance conductor layer 28*b*, for example, has an impedance of about 50Ω. In this way, the capacitors C1 and C2 are terminated by the resistance conductor layer 28*b*. Thus, it is also possible to build the termination resistor R3 into the directional coupler 10*g*. In this case, compared with when the termination resistor is provided on the outside, the substrate on which this directional coupler 10*g* is to be mounted can be reduced in size by the amount of space that would have been taken up by the termination resistor R3.

Eighth Preferred Embodiment

Figure 15:
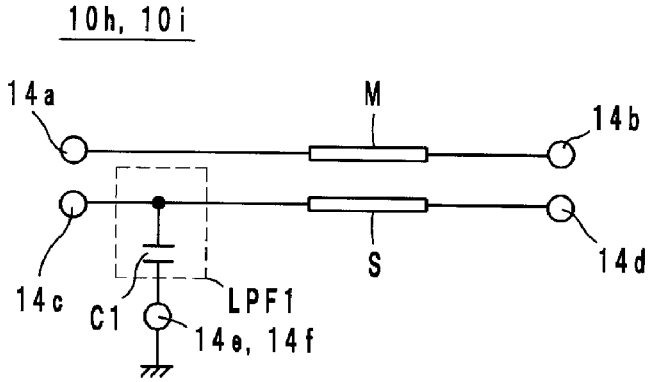
FIG. 15 is an equivalent circuit diagram of a directional coupler according to an eighth or ninth preferred embodiment of the present invention.
Figure 16:
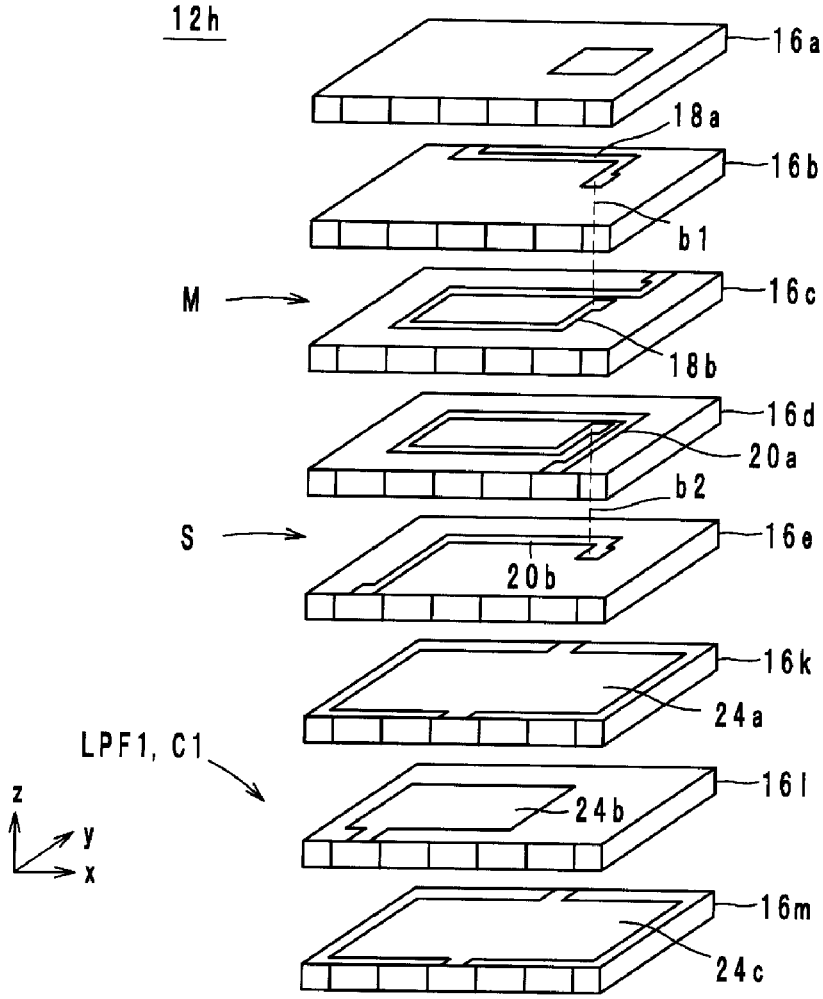
FIG. 16 is an exploded perspective view of the multilayer body of the directional coupler according to the seventh preferred embodiment of the present invention.

Hereafter, the configuration of a directional coupler 10*h* according to an eighth preferred embodiment will be described while referring to the drawings. FIG. 15 is an equivalent circuit diagram for directional couplers 10*h* and 10*i* according to the eighth preferred embodiment and a ninth preferred embodiment. FIG. 16 is an exploded perspective view of a multilayer body 12*h* of the directional coupler 10*h* according to the seventh preferred embodiment.

The directional coupler 10*h*, as illustrated in FIG. 15, has a circuit configuration in which the coil L1 of the directional coupler 10*a* illustrated in FIG. 1 and FIG. 6 is not provided. Therefore, the directional coupler 10*h*, as illustrated in FIG. 16, does not include the insulator layers 16*f* to 16*j*, the line portions 22*a* to 22*d*, the shielding conductor layer 26*a* and the via hole conductors b3 to b7. The line portion 20*b* is connected to the outer electrode 14*c*.

Figure 17:
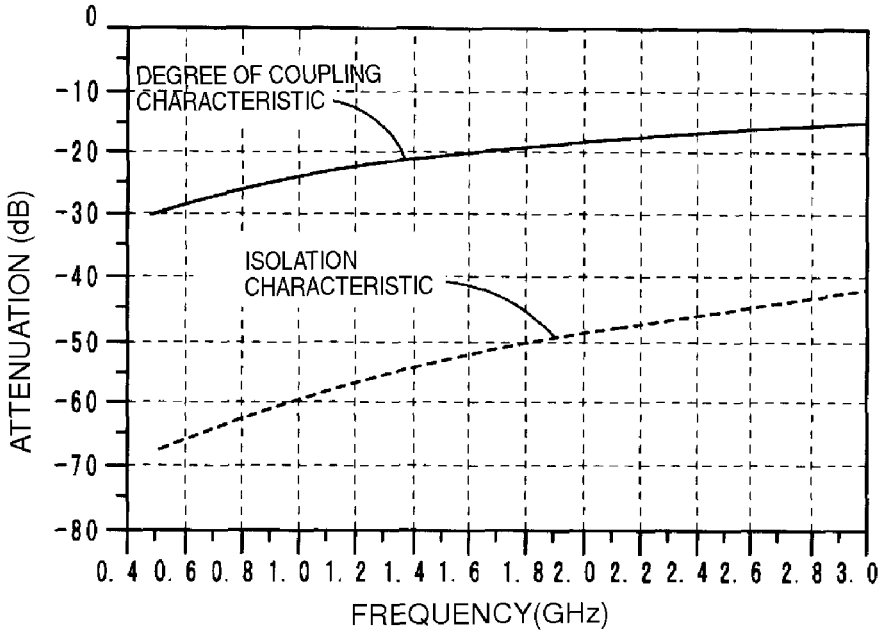
FIG. 17 is a graph illustrating a degree of coupling characteristic and an isolation characteristic of a conventional directional coupler that does not contain a low pass filter.
Figure 18:
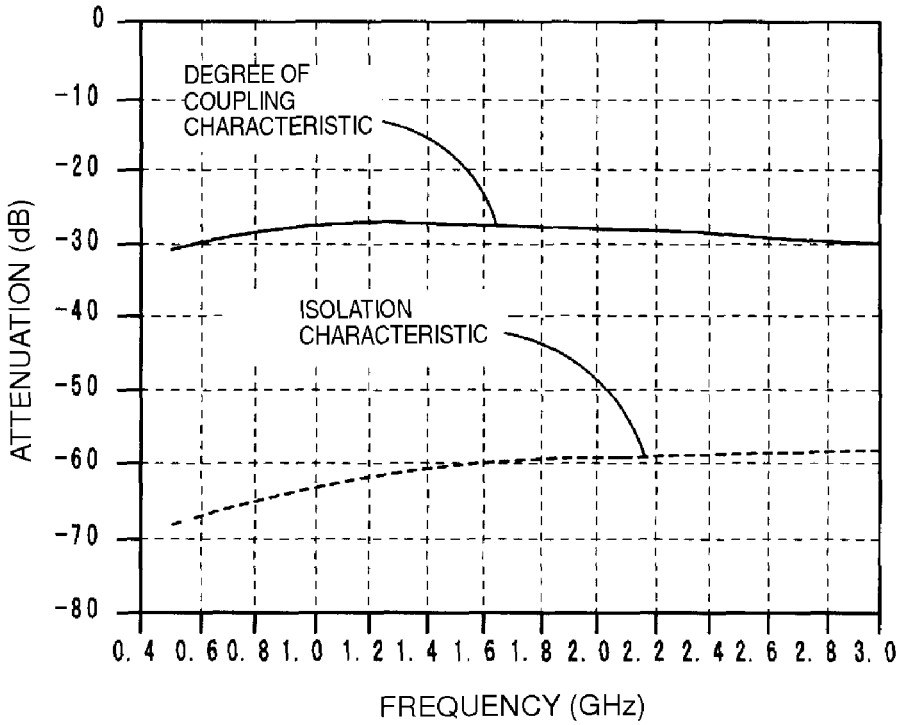
FIG. 18 is a graph illustrating a degree of coupling characteristic and an isolation characteristic of a directional coupler.

As described above, even if the low pass filter LPF1 includes only the capacitor C1 without using the coil L1, as in the directional coupler 10*h*, it is possible to make the degree of coupling characteristic close to constant. FIG. 17 is a graph illustrating a degree of coupling characteristic and an isolation characteristic of a conventional directional coupler that does not contain the low pass filter LPF1. FIG. 18 is a graph illustrating a degree of coupling characteristic and an isolation characteristic of the directional coupler 10*h*. In FIG. 17 and FIG. 18, the vertical axis represents attenuation and the horizontal axis represents frequency.

In the conventional directional coupler, the degree of coupling between the main line and the sub-line increases with increasing frequency of the signal. Therefore, as illustrated in FIG. 17, the ratio of power input from the input port to power output to the coupling port increases with increasing frequency in the degree of coupling characteristic of the conventional directional coupler.

Accordingly, in the directional coupler 10*h*, the low pass filter LPF1 is connected between the outer electrode 14*c* and the sub-line S. The low pass filter LPF1 has an insertion loss characteristic in which attenuation increases with increasing frequency. Consequently, even when the power of a signal output from the sub-line S to the outer electrode 14*c* increases due to the frequency of the signal increasing, the power of the signal is reduced by the low pass filter LPF1. As a result, as illustrated in FIG. 18, the degree of coupling characteristic can be close to constant in the directional coupler 10*h*.

Furthermore, comparing the isolation characteristic of the directional coupler 10*h* illustrated in FIG. 18 and the isolation characteristic of the conventional directional coupler illustrated in FIG. 17, the attenuation of the isolation characteristic is not increased by providing the low pass filter LPF1.

Ninth Preferred Embodiment

Figure 19:
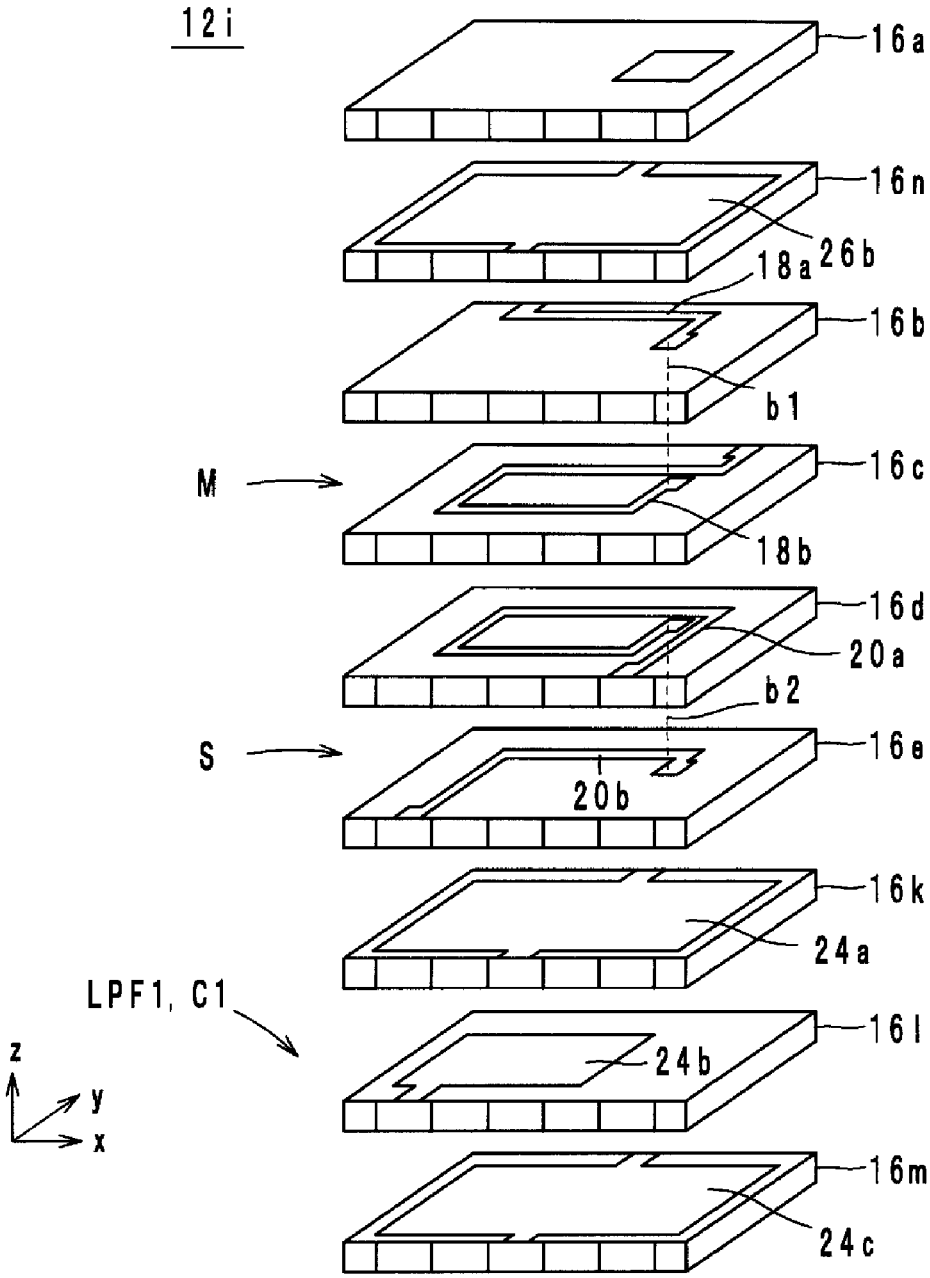
FIG. 19 is an exploded perspective view of a multilayer body of the directional coupler according to the ninth preferred embodiment of the present invention.

Hereafter, the configuration of a directional coupler 10*i* according to a ninth preferred embodiment will be described while referring to the drawings. FIG. 19 is an exploded perspective view of a multilayer body 12*i* of the directional coupler 10*i* according to the ninth preferred embodiment.

The circuit configuration of the directional coupler 10*i* is the same as that of the directional coupler 10*h* and therefore description thereof will be omitted. A difference between the directional coupler 10*i* and the directional coupler 10*h* is that, as illustrated in FIG. 19, the insulator layer 16*n*, on which the shielding conductor layer 26*b* is provided, is provided between the insulator layers 16*a* and 16*b*.

More specifically, the shielding conductor layer 26*b* is arranged so as to cover substantially the entire surface of the insulator layer 16*n* and is connected to the outer electrodes 14*e* and 14*f*. That is, a ground potential is applied to the shielding conductor layer 26*b*. The shielding conductor layer 26*b* is provided on the positive side of the main line M in the z-axis direction. In this way, the shielding conductor layer 26*b* is arranged so that the main line M and the sub-line S are interposed between the shielding conductor layer 26*b* and the planar conductor layers 24*a* and 24*c* in the z-axis direction. Thus, leakage of magnetic fields generated by the main line M and the sub-line S to outside of the multilayer body 12*i* can be prevented by the shielding conductor layer 26*b* and the planar conductor layers 24*a* and 24*c*.

Tenth Preferred Embodiment

Figure 20:
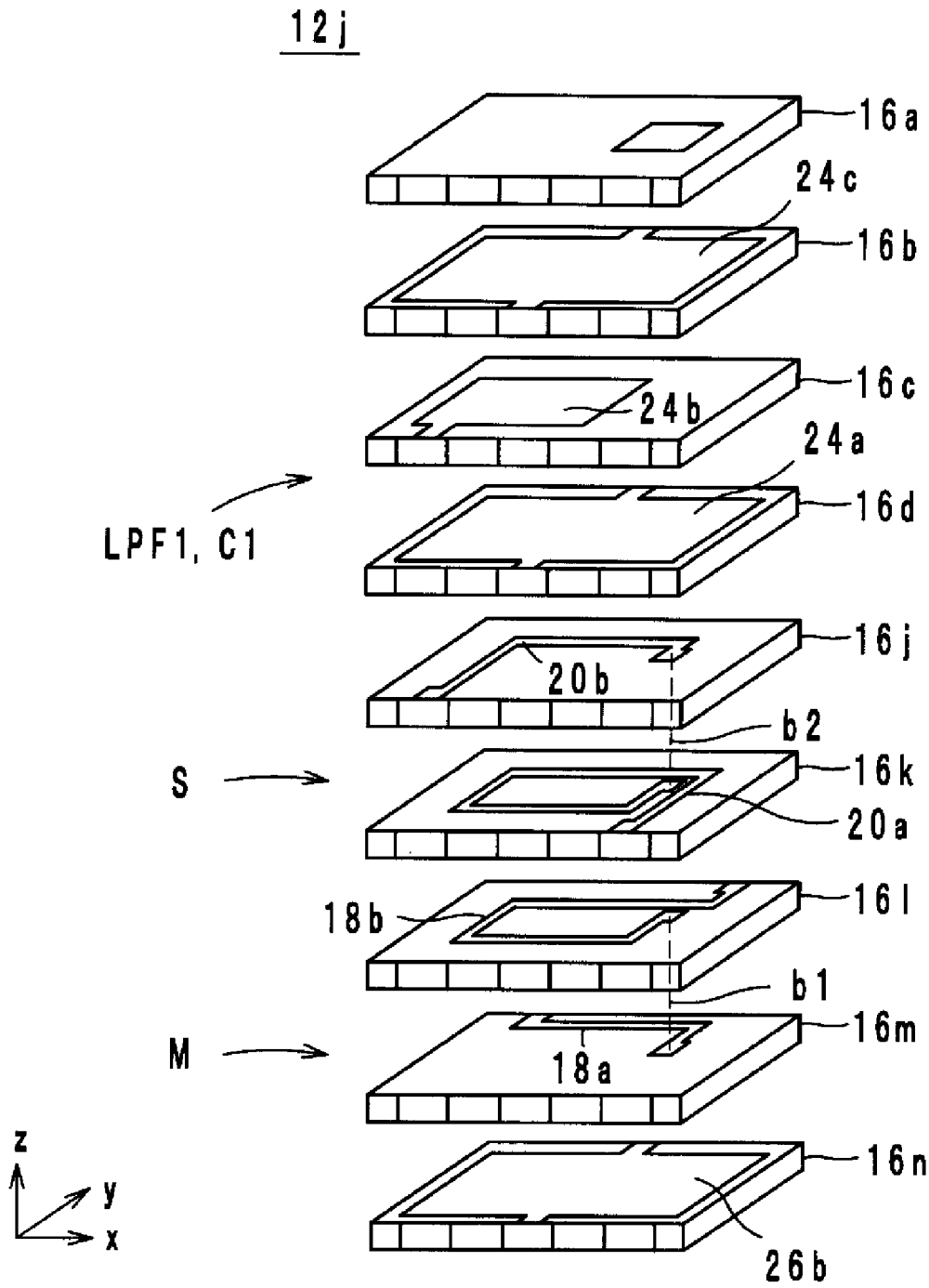
FIG. 20 is an exploded perspective view of a multilayer body of a directional coupler according to a tenth preferred embodiment of the present invention.

Hereafter, the configuration of a directional coupler 10*j* according to a tenth preferred embodiment will be described while referring to the drawings. FIG. 20 is an exploded perspective view of a multilayer body 12*j* of the directional coupler 10*j* according to the tenth preferred embodiment.

The circuit configuration of the directional coupler 10*j* preferably is the same as that of the directional couplers 10*h* and 10*i* and therefore description thereof will be omitted. A difference between the directional coupler 10*j* and the directional coupler 10*i* is that the order in which the main line M, the sub-line S, the low pass filter LPF1 (capacitor C1), and the shielding conductor layer 26*b* are stacked is different.

More specifically, in the directional coupler 10*i*, as illustrated in FIG. 19, the shielding conductor layer 26*b*, the main line M, the sub-line S and the capacitor C1 are arranged in this order from the positive side to the negative side in the z-axis direction. In contrast, in the directional coupler 10*j*, as illustrated in FIG. 20, the capacitor C1, the sub-line S, the main line M and the shielding conductor layer 26*b* are arranged in this order from the positive side to the negative side in the z-axis direction.

With the directional coupler 10*j* having the above-described configuration, it is also possible to make the degree of coupling characteristic close to constant while preventing the magnetic fields generated by the main line M and the sub-line S from leaking to the outside, similarly to the directional coupler 10*i*.

Eleventh Preferred Embodiment

Figure 21:
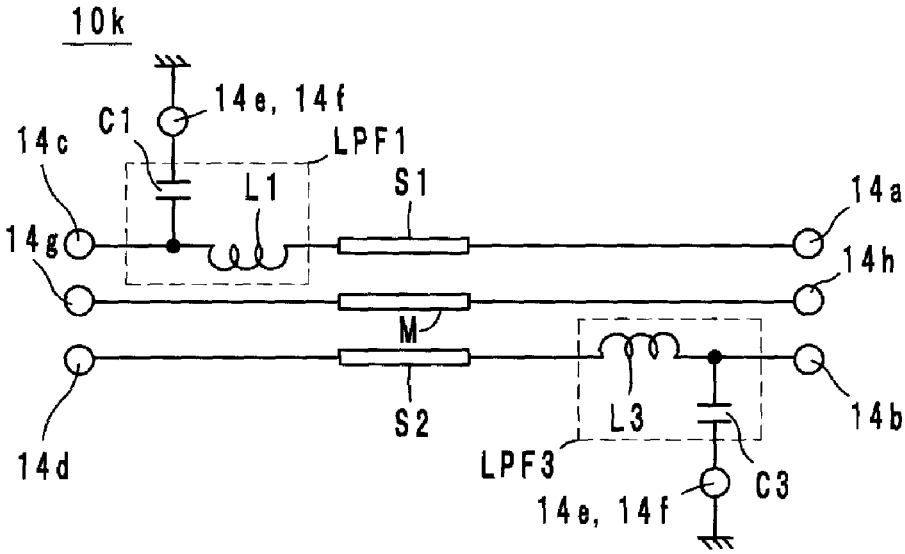
FIG. 21 is an equivalent circuit diagram of a directional coupler according to an eleventh preferred embodiment of the present invention.

Hereafter, the configuration of a directional coupler 10*k* according to an eleventh preferred embodiment will be described while referring to the drawings. FIG. 21 is an equivalent circuit diagram of the directional coupler 10*k* according to the eleventh preferred embodiment.

The circuit configuration of the directional coupler 10*k* will now be described. The directional coupler 10*k* preferably includes the outer electrodes (terminals) 14*a* to 14*h*, the main line M, sub-lines S1 and S2 and low pass filters LPF1 and LPF3, as a circuit configuration. The main line M is connected between the outer electrodes 14*g* and 14*h*. The sub-line S1 is connected between the outer electrodes 14*c* and 14*a* and is electromagnetically coupled with the main line M. The sub-line S2 is connected between the outer electrodes 14*d* and 14*b* and is electromagnetically coupled with the main line M.

In addition, the low pass filter LPF1 is connected between the outer electrode 14*c* and the sub-line S1 and has a characteristic that attenuation increases with increasing frequency in a predetermined frequency band. The low pass filter LPF1 includes the capacitor C1 and the coil L1. The coil L1 is connected in series between the outer electrode 14*c* and the sub-line S1. The capacitor C1 is connected between a point between the sub-line S1 and the outer electrode 14*c* (more precisely a point between the coil L1 and the outer electrode 14*c*), and the outer electrodes 14*e* and 14*f*.

In addition, the low pass filter LPF3 is connected between the outer electrode 14*b* and the sub-line S2 and has a characteristic that attenuation increases with increasing frequency in a predetermined frequency band. The low pass filter LPF3 includes a capacitor C3 and a coil L3. The coil L3 is connected in series between the outer electrode 14*b* and the sub-line S2. The capacitor C3 is connected between a point between the sub-line S2 and the outer electrode 14*b* (more precisely a point between the coil L3 and the outer electrode 14*b*), and the outer electrodes 14*e* and 14*f*.

In the above-described directional coupler 10*k*, the outer electrode 14*g* is used as an input port and the outer electrode 14*h* is used as an output port. Furthermore, the outer electrode 14*c* is used as a first coupling port and the outer electrode 14*a* is used as a termination port that is terminated at about 50Ω, for example. Furthermore, the outer electrode 14*b* is used as a second coupling port and the outer electrode 14*d* is used as a termination port that is terminated at about 50Ω, for example. The outer electrodes 14*e* and 14*f* are used as ground ports, which are grounded. When a signal is input to the outer electrode 14*g*, the signal is output from the outer electrode 14*h*. Furthermore, since the main line M and the sub-lines S1 and S2 are electromagnetically coupled with each other, a signal having a power that is proportional to the power of the input signal is output from the outer electrodes 14*b* and 14*c*.

Figure 22:
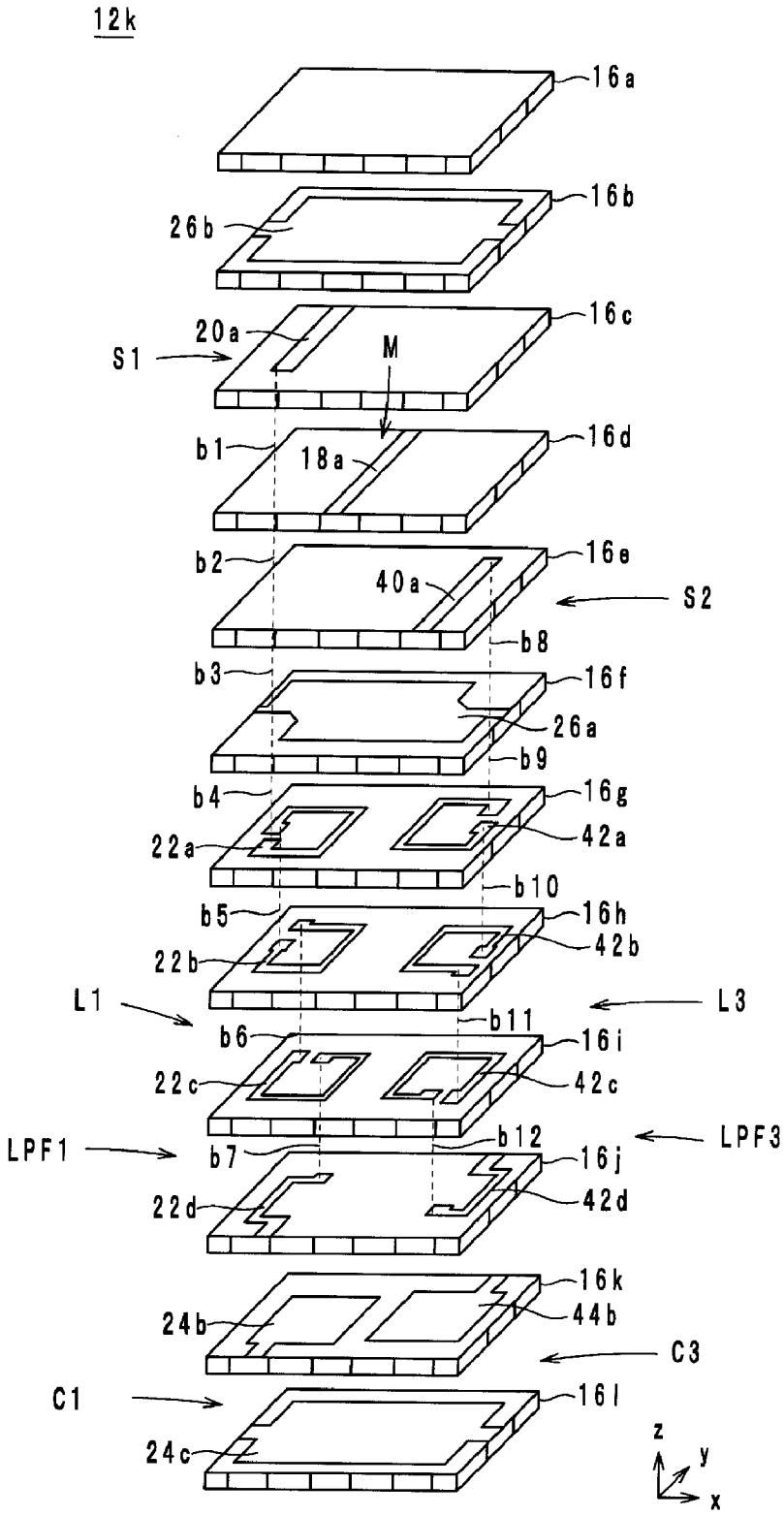
FIG. 22 is an exploded perspective view of a multilayer body of the directional coupler according to the eleventh preferred embodiment of the present invention.

Next, a specific configuration of the directional coupler 10*k* will be described while referring to the drawings. FIG. 22 is an exploded perspective view of a multilayer body 12*k* of the directional coupler 10*k* according to the eleventh preferred embodiment. FIG. 12 will be used as an external perspective view of the directional coupler 10*k*.

The directional coupler 10*k*, as illustrated in FIG. 12 and FIG. 22, includes the multilayer body 12*k*, the outer electrodes 14 (14*a* to 14*h*), the main line M, the sub-lines S1 and S2, the low pass filters LPF1 and LPF3 and shielding conductor layers 26*a* and 26*b*. The multilayer body 12*k*, as illustrated in FIG. 12, preferably has a rectangular parallelepiped shape, and, as illustrated in FIG. 22, and preferably is formed by the insulator layers 16 (16*a* to 16*l*) being stacked in this order from the positive side to the negative side in the z-axis direction. The insulator layers 16 preferably are dielectric ceramic layers having a rectangular or substantially rectangular shape, for example.

The outer electrodes 14*a*, 14*h* and 14*b* are provided on a lateral surface of the multilayer body 12*k* on the positive side in the y-axis direction so as to be adjacent to one another in this order from the negative side to the positive side in the x-axis direction. The outer electrodes 14*c*, 14*g* and 14*d* are provided on a lateral surface of the multilayer body 12*k* on the negative side in the y-axis direction so as to be adjacent to one another in this order from the negative side to the positive side in the x-axis direction.

The main line M, as illustrated in FIG. 22, preferably includes the line portion 18*a*. The line portion 18*a* is a line-shaped conductor layer that is provided on the insulator layer 16*d*. The line portion 18*a* extends in the y-axis direction and is connected to the outer electrodes 14*g* and 14*h*. In this way, the main line M is connected between the outer electrodes 14*g* and 14*h*.

The sub-line S1, as illustrated in FIG. 22, preferably includes the line portion 20*a* and the via hole conductors b1 to b4. The line portion 20*a* is a line-shaped conductor layer that is provided on the insulator layer 16*c* on the negative side of the line portion 18*a* in the x-axis direction when viewed in plan from the positive side in the z-axis direction. The line portion 20*a* extends in the y-axis direction parallel to the line portion 18*a* and is connected to the outer electrode 14*a*. Thus, the main line M and the sub-line S1 are electromagnetically coupled with each other. The via hole conductors b1 to b4 penetrate through the insulator layers 16*c* to 16*f* in the z-axis direction and are connected to one another. In addition, the via hole conductor b1 is connected to an end portion of the line portion 20*a* on the negative side in the y-axis direction.

The low pass filter LPF1 preferably includes the coil L1 and the capacitor C1. The coil L1 preferably includes the line portions 22 (22*a* to 22*d*) and the via hole conductors b5 to b7 and has a spiral shape that loops in the counterclockwise direction while advancing from the positive side to the negative side in the z-axis direction. Here, in the coil L1, an end portion on the upstream side in the counterclockwise direction is termed an upstream end and an end portion on the downstream side in the counterclockwise direction is termed a downstream end. The line portion 22*a* is a line-shaped conductor layer that is provided on the insulator layer 16*g* and the upstream end thereof is connected to the via hole conductor b4. The line portions 22*b* and 22*c* are line-shaped conductor layers that are provided on the insulator layers 16*h* and 16*i*, respectively. The line portion 22*d* is a line-shaped conductor layer that is provided on the insulator layer 16*j* and the downstream end thereof is connected to the outer electrode 14*c*. The via hole conductor b5 penetrates through the insulator layer 16*g* in the z-axis direction and connects the downstream end of the line portion 22*a* and the upstream end of the line portion 22*b* to each other. The via hole conductor b6 penetrates through the insulator layer 16*h* in the z-axis direction and connects the downstream end of the line portion 22*b* and the upstream end of the line portion 22*c* to each other. The via hole conductor b7 penetrates through the insulator layer 16*i* in the z-axis direction and connects the downstream end of the line portion 22*c* and the upstream end of the line portion 22*d* to each other. In this way, the coil L1 is connected between the sub-line S1 and the outer electrode 14*c*.

The capacitor C1 includes planar conductor layers 24 (24*b* and 24*c*). The planar conductor layer 24*c* is arranged so as to cover substantially the entire surface of the insulator layer 16*l* and is connected to the outer electrodes 14*e* and 14*f*. The planar conductor layer 24*b* is provided on the insulator layer 16*k* and is connected to the outer electrode 14*c*. The planar conductor layer 24*b* preferably has a rectangular or substantially rectangular shape and is superposed with the planar conductor layer 24*c* when viewed in plan from the z-axis direction. In this way, a capacitance is generated between the planar conductor layer 24*c* and the planar conductor layer 24*b*. The capacitor C1 is connected between the outer electrode 14*c* and the outer electrodes 14*e* and 14*f*. That is, the capacitor C1 is connected between a point between the coil L1 and the outer electrode 14*c*, and the outer electrodes 14*e* and 14*f*.

The sub-line S2, as illustrated in FIG. 22, includes a line portion 40*a* and the via hole conductors b8 and b9. The line portion 40*a* is a line-shaped conductor layer that is provided on the insulator layer 16*e* on the positive side of the line portion 18*a* in the x-axis direction when viewed in plan from the positive side in the z-axis direction. The line portion 40*a* extends in the y-axis direction parallel to the line portion 18*a* and is connected to the outer electrode 14*d*. Thus, the main line M and the sub-line S2 are electromagnetically coupled with each other. The via hole conductors b8 and b9 penetrate through the insulator layers 16*e* and 16*f* in the z-axis direction and are connected to each other. In addition, the via hole conductor b8 is connected to an end portion of the line portion 40*a* on the positive side in the y-axis direction.

The low pass filter LPF3 includes the coil L3 and the capacitor C3. The coil L3 includes line portions 42 (42*a* to 42*d*) and the via hole conductors b10 to b12 and has a spiral shape that loops in the counterclockwise direction while advancing from the positive side to the negative side in the z-axis direction. Here, in the coil L3, an end portion on the upstream side in the counterclockwise direction is termed an upstream end and an end portion on the downstream side in the counterclockwise direction is termed a downstream end. The line portion 42*a* is a line-shaped conductor layer that is provided on the insulator layer 16*g* and the upstream end thereof is connected to the via hole conductor b9. The line portions 42*b* and 42*c* are line-shaped conductor layers that are provided on the insulator layers 16*h* and 16*i*, respectively. The line portion 42*d* is a line-shaped conductor layer that is provided on the insulator layer 16*j* and the downstream end thereof is connected to the outer electrode 14*b*. The via hole conductor b10 penetrates through the insulator layer 16*g* in the z-axis direction and connects the downstream end of the line portion 42*a* and the upstream end of the line portion 42*b* to each other. The via hole conductor b11 penetrates through the insulator layer 16*h* in the z-axis direction and connects the downstream end of the line portion 42*b* and the upstream end of the line portion 42*c* to each other. The via hole conductor b12 penetrates through the insulator layer 16*i* in the z-axis direction and connects the downstream end of the line portion 42*c* and the upstream end of the line portion 42*d* to each other. In this way, the coil L3 is connected between the sub-line S2 and the outer electrode 14*d*.

The capacitor C3 includes planar conductor layers 44*b* and 24*c*. The planar conductor layer 24*c* is arranged so as to cover substantially the entire surface of the insulator layer 16*l* and is connected to the outer electrodes 14*e* and 14*f*. The planar conductor layer 44*b* is provided on the insulator layer 16*k* and is connected to the outer electrode 14*b*. The planar conductor layer 44*b* preferably has a rectangular or substantially rectangular shape and is superposed with the planar conductor layer 24*c* when viewed in plan from the z-axis direction. In this way, a capacitance is generated between the planar conductor layer 24*c* and the planar conductor layer 44*b*. The capacitor C3 is connected between the outer electrode 14*b* and the outer electrodes 14*e* and 14*f*. That is, the capacitor C3 is connected between a point between the coil L3 and the outer electrode 14*b*, and the outer electrodes 14*e* and 14*f*.

The shielding conductor layers 26*a* and 26*b* are arranged so as to cover substantially the entire surfaces of the insulator layers 16*f* and 16*b* and are connected to the outer electrodes 14*e* and 14*f*. That is, a ground potential is applied to the shielding conductor layers 26*a* and 26*b*. The shielding conductor layer 26*a* is provided between the main line M and the sub-lines S1 and S2, and the coils L1 and L3 in the z-axis direction, whereby electromagnetic coupling between the sub-lines S1 and S2 and the coils L1 and L3 is prevented and suppressed.

Twelfth Preferred Embodiment

Figure 23:
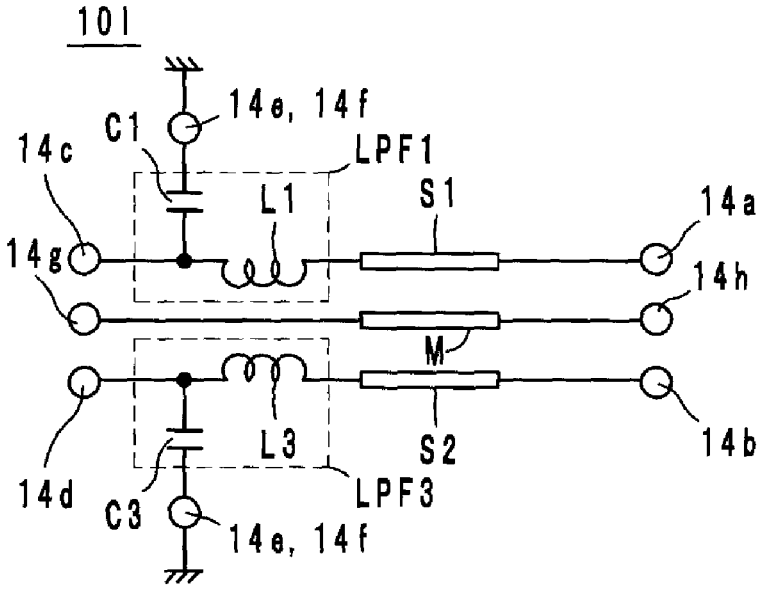
FIG. 23 is an equivalent circuit diagram of a directional coupler according to a twelfth preferred embodiment of the present invention.

Hereafter, the configuration of a directional coupler 10*l* according to a twelfth preferred embodiment will be described while referring to the drawings. FIG. 23 is an equivalent circuit diagram of the directional coupler 10*l* according to the twelfth preferred embodiment.

The circuit configuration of the directional coupler 10*l* will now be described. The directional coupler 10*l* is equipped with the outer electrodes (terminals) 14*a* to 14*h*, the main line M, the sub-lines S1 and S2 and the low pass filters LPF1 and LPF3, as a circuit configuration. The configurations of the main line M, the sub-line S1 and the low pass filter LPF1 of the directional coupler 10*l* are similar to those of the main line M, the sub-line S1 and the low pass filter LPF1 of the directional coupler 10*k* and therefore description thereof will be omitted.

In addition, the low pass filter LPF3 is connected between the outer electrode 14*d* and the sub-line S2 and has a characteristic that attenuation increases with increasing frequency in a predetermined frequency band. The low pass filter LPF3 includes the capacitor C3 and the coil L3. The coil L3 is connected in series between the outer electrode 14*d* and the sub-line S2. The capacitor C3 is connected between a point between the sub-line S2 and the outer electrode 14*d* (more precisely a point between the coil L3 and the outer electrode 14*d*), and the outer electrodes 14*e* and 14*f*.

In the above-described directional coupler 10*l*, the outer electrode 14*g* is used as an input port and the outer electrode 14*h* is used as an output port. Furthermore, the outer electrode 14*c* is used as a first coupling port and the outer electrode 14*a* is used as a termination port that is terminated at 50Ω. Furthermore, the outer electrode 14*d* is used as a second coupling port and the outer electrode 14*b* is used as a termination port that is terminated at about 50Ω, for example. The outer electrodes 14*e* and 14*f* are used as ground ports, which are grounded. When a signal is input to the outer electrode 14*g*, the signal is output from the outer electrode 14*h*. Furthermore, since the main line M and the sub-line S1 are electromagnetically coupled with each other, a signal having a power that is proportional to the power of the input signal is output from the outer electrode 14*c*.

Here, a signal output from the outer electrode 14*h* is partially reflected by an antenna or the like connected to the outer electrode 14*h*. Such a reflected signal is input to the main line M from the outer electrode 14*h*. Since the main line M and the sub-line S2 are electromagnetically coupled with each other, a signal having a power that is proportional to the power of a reflected signal input from the outer electrode 14*d* is output from the outer electrode 14*d*.

Figure 24:
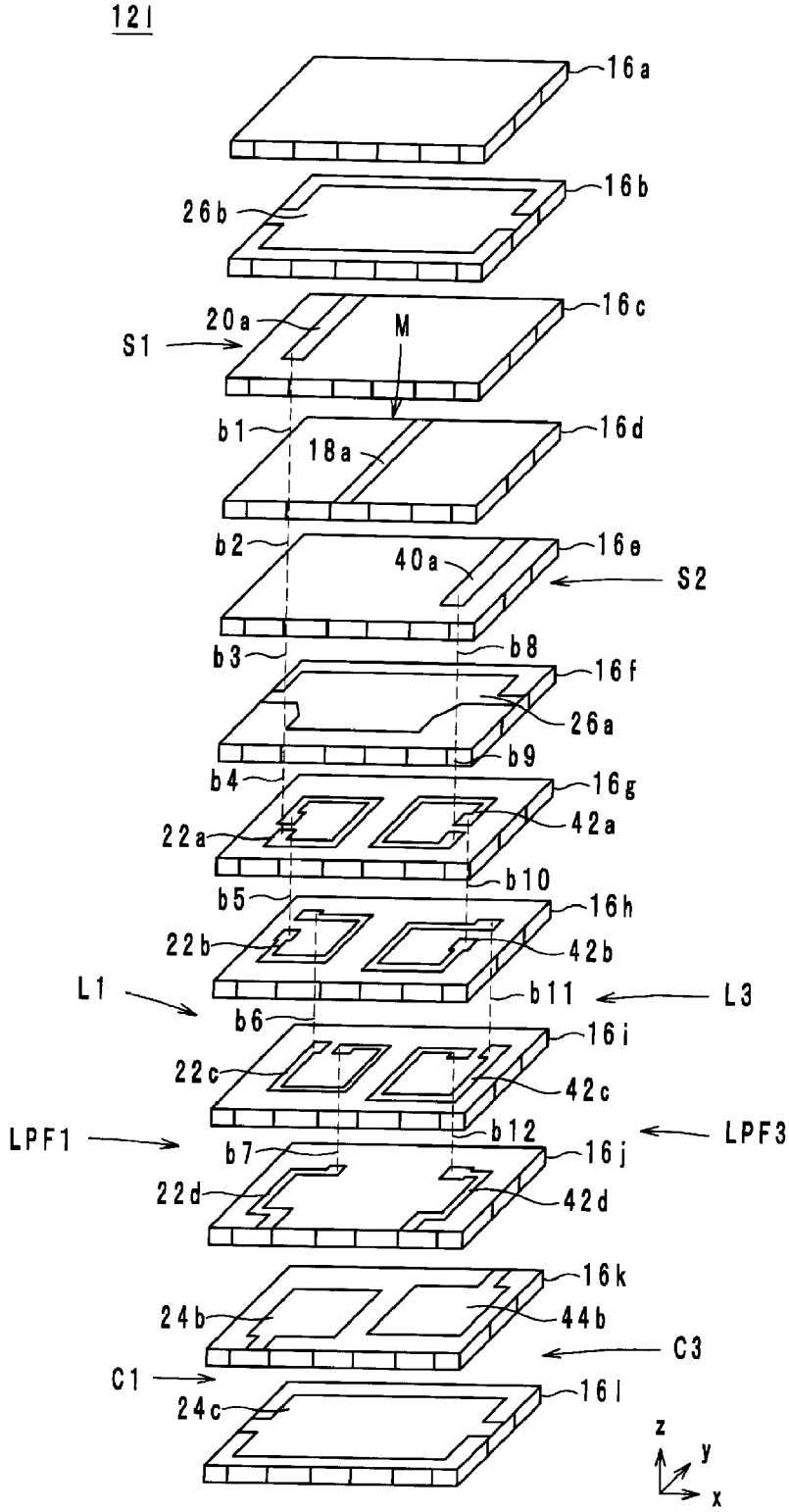
FIG. 24 is an exploded perspective view of a multilayer body of the directional coupler according to the twelfth preferred embodiment of the present invention.

Next, a specific configuration of the directional coupler 10*l* will be described while referring to the drawings. FIG. 24 is an exploded perspective view of a multilayer body 12*l* of the directional coupler 10*l* according to the twelfth preferred embodiment. FIG. 12 will be used as an external perspective view of the directional coupler 10*l*.

The directional coupler 10*l*, as illustrated in FIG. 12 and FIG. 24, preferably includes the multilayer body 12*l*, the outer electrodes 14 (14*a* to 14*h*), the main line M, the sub-lines S1 and S2, the low pass filters LPF1 and LPF3 and the shielding conductor layers 26*a* and 26*b*. The multilayer body 12*l*, as illustrated in FIG. 12, preferably has a rectangular parallelepiped shape, and, as illustrated in FIG. 24, and preferably is formed by the insulator layers 16 (16*a* to 16*l*) being stacked in this order from the positive side to the negative side in the z-axis direction. The insulator layers 16 preferably are dielectric ceramic layers having a rectangular or substantially rectangular shape, for example.

The outer electrodes 14*a*, 14*h* and 14*b* are provided on a lateral surface of the multilayer body 12*l* on the positive side in the y-axis direction so as to be adjacent to one another in this order from the negative side to the positive side in the x-axis direction. The outer electrodes 14*c*, 14*g* and 14*d* are provided on a lateral surface of the multilayer body 12*l* on the negative side in the y-axis direction so as to be adjacent to one another in this order from the negative side to the positive side in the x-axis direction.

The main line M, as illustrated in FIG. 6, includes the line portion 18*a*. The line portion 18*a* is a line-shaped conductor layer that is provided on the insulator layer 16*d*. The line portion 18*a* extends in the y-axis direction and is connected to the outer electrodes 14*g* and 14*h*. In this way, the main line M is connected between the outer electrodes 14*g* and 14*h*.

The configurations of the main line M, the sub-line S1 and the low pass filter LPF1 of the directional coupler 10*l* preferably are similar to those of the main line M, the sub-line S1 and the low pass filter LPF1 of the directional coupler 10*k* and therefore description thereof will be omitted.

The sub-line S2, as illustrated in FIG. 24, includes the line portion 40*a* and the via hole conductors b8 and b9. The line portion 40*a* is a line-shaped conductor layer that is provided on the insulator layer 16*e* on the positive side of the line portion 18*a* in the x-axis direction when viewed in plan from the positive side in the z-axis direction. The line portion 40*a* extends in the y-axis direction parallel to the line portion 18*a* and is connected to the outer electrode 14*b*. Thus, the main line M and the sub-line S2 are electromagnetically coupled with each other. The via hole conductors b8 and b9 penetrate through the insulator layers 16*e* and 16*f* in the z-axis direction and are connected to each other. In addition, the via hole conductor b8 is connected to an end portion of the line portion 40*a* on the negative side in the y-axis direction.

The low pass filter LPF3 includes the coil L3 and the capacitor C3. The coil L3 includes the line portions 42 (42*a* to 42*d*) and the via hole conductors b10 to b12 and has a spiral shape that loops in the clockwise direction while advancing from the positive side to the negative side in the z-axis direction. Here, in the coil L3, an end portion on the upstream side in the clockwise direction is termed an upstream end and an end portion on the downstream side in the clockwise direction is termed a downstream end. The line portion 42*a* is a line-shaped conductor layer that is provided on the insulator layer 16*g* and the upstream end thereof is connected to the via hole conductor b9. The line portions 42*b* and 42*c* are line-shaped conductor layers that are provided on the insulator layers 16*h* and 16*i*, respectively. The line portion 42*d* is a line-shaped conductor layer that is provided on the insulator layer 16*j* and the downstream end thereof is connected to the outer electrode 14*d*. The via hole conductor b10 penetrates through the insulator layer 16*g* in the z-axis direction and connects the downstream end of the line portion 42*a* and the upstream end of the line portion 42*b* to each other. The via hole conductor b11 penetrates through the insulator layer 16*h* in the z-axis direction and connects the downstream end of the line portion 42*b* and the upstream end of the line portion 42*c* to each other. The via hole conductor b12 penetrates through the insulator layer 16*i* in the z-axis direction and connects the downstream end of the line portion 42*c* and the upstream end of the line portion 42*d* to each other. In this way, the coil L3 is connected between the sub-line S2 and the outer electrode 14*d*.

The capacitor C3 preferably includes the planar conductor layers 44*b* and 24*c*. The planar conductor layer 24*c* is arranged so as to cover substantially the entire surface of the insulator layer 16*l* and is connected to the outer electrodes 14*e* and 14*f*. The planar conductor layer 44*b* is provided on the insulator layer 16*k* and is connected to the outer electrode 14*b*. The planar conductor layer 44*b* preferably has a rectangular or substantially rectangular shape and is superposed with the planar conductor layer 24*c* when viewed in plan from the z-axis direction. In this way, a capacitance is generated between the planar conductor layer 24*c* and the planar conductor layer 44*b*. The capacitor C3 is connected between the outer electrode 14*b* and the outer electrodes 14*e* and 14*f*. That is, the capacitor C3 is connected between a point between the coil L3 and the outer electrode 14*b*, and the outer electrodes 14*e* and 14*f*.

The shielding conductor layer 26*a* is arranged so as to cover substantially the entire surface of the insulator layer 16*f* and is connected to the outer electrodes 14*e* and 14*f*. That is, a ground potential is applied to the shielding conductor layer

26*a*. The shielding conductor layer 26*a* is provided between the main line M and the sub-lines S1 and S2, and the coils L1 and L3 in the z-axis direction, whereby electromagnetic coupling between the sub-lines S1 and S2 and the coils L1 and L3 is prevented and suppressed.

In the directional couplers 10*a* to 10*l*, the main line M and the sub-lines S, S1 and S2, and the low pass filters LPF1, LPF2 and LPF3 are arranged so as to be adjacent to one another in the z-axis direction. However, the positional relationship between the main line M and the sub-lines S, S1 and S2 and the low pass filters LPF1, LPF2 and LPF3 is not limited to this. For example, the main line M, the sub-lines S, S1 and S2 and the low pass filters LPF1, LPF2 and LPF3 may be arranged so as to be adjacent to one another in x-axis direction or the y-axis direction.

The directional couplers 10*a* to 10*l* preferably are, for example, multilayer electronic components formed by stacking insulator layers 16, which are composed of a dielectric ceramic, on top of one another. However, the directional couplers 10*a* to 10*l* do not need to be multilayer electronic components. For example, the directional couplers 10*a* to 10*l* may include semiconductor chips. The number of stacked layers of a semiconductor chip would be fewer than that of a multilayer electronic component. Accordingly, arranging the main line M, the sub-lines S, S1 and S2, and the low pass filters LPF1, LPF2 and LPF3 so as to be adjacent to one another in the z-axis direction would be difficult. Therefore, in this case, it would preferable that the main line M, the sub-lines S, S1 and S2, and the low pass filters LPF1, LPF2 and LPF3 be arranged adjacent to one another in the x-axis direction or the y-axis direction.

In addition, in the directional couplers 10*a* to 10*l*, 824 MHz to 1910 MHz, for example, was preferably adopted as a predetermined frequency band. However, the predetermined frequency band is not limited to this. For example, in the case of WCDMA, any of the following six frequency bands can be adopted as the frequency band of a signal input to the directional couplers 10*a* to 10*l*.

Band 5: 824 MHz to 849 MHz
Band 8: 880 MHz to 915 MHz
Band 3: 1710 MHz to 1785 MHz
Band 2: 1850 MHz to 1910 MHz
Band 1: 1920 MHz to 1980 MHz
Band 7: 2500 MHz to 2570 MHz Therefore, the predetermined frequency band is a frequency band obtained by appropriately combining the above six frequency bands. For example, a frequency band obtained by combining Band 1, Band 2, Band 3, Band 5 and Band 8 is from 824 MHz to 915 MHz and from 1710 MHz to 1980 MHz. Therefore, the predetermined frequency band in this case is 824 MHz to 1980 MHz.

As described above, preferred embodiments of the present invention are useful for directional couplers and are particularly excellent in that the degree of coupling characteristic can be close to constant.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler to be used in a predetermined frequency band, comprising:

first to fifth terminals;

a main line that is connected between the first terminal and the second terminal;

a first sub-line that is connected between the third terminal and the fourth terminal and that is electromagnetically coupled with the main line;

a first low pass filter that is connected between the third terminal and the first sub-line and has a characteristic in which attenuation increases with increasing frequency in the predetermined frequency band; wherein the fifth terminal is a ground terminal;

the first low pass filter includes a first coil that is connected in series between the third terminal and the first sub-line, and a first capacitor that is connected between a point between the first coil and the first sub-line, and the fifth terminal.

2. The directional coupler according to claim 1, wherein the first terminal is an input terminal to which a signal is input, the second terminal is a first output terminal from which the signal is output, the third terminal is a second output terminal from which a signal having a power that is proportional to the power of the signal is output, and the fourth terminal is a termination terminal that is terminated.

3. The directional coupler according to claim 1, further comprising an eighth terminal and a ninth terminal, a second sub-line that is connected between the eighth terminal and the ninth terminal and that is electromagnetically coupled with the main line, and a third low pass filter that is connected between the ninth terminal and the second sub-line and has a characteristic in which attenuation increases with increasing frequency in the predetermined frequency band.

4. The directional coupler according to claim 1, further comprising an eighth terminal and a ninth terminal, a second sub-line that is connected between the eighth terminal and the ninth terminal and that is electromagnetically coupled with the main line, and a third low pass filter that is connected between the eighth terminal and the second sub-line and has a characteristic that attenuation increases with increasing frequency in the predetermined frequency band.

5. The directional coupler according to claim 1, further comprising a second low pass filter that is connected between the fourth terminal and the first sub-line and has a characteristic in which attenuation increases with increasing frequency in the predetermined frequency band.

6. The directional coupler according to claim 5, further comprising a sixth terminal that is a termination terminals that is terminated, wherein the second low pass filter includes a second coil that is connected in series between the fourth terminal and the first sub-line and a second capacitor that is connected between a point between the fourth terminal and the first sub-line, and the sixth terminal.

7. The directional coupler according to claim 6, wherein the second capacitor is connected between a point between the second coil and the first sub-line, and the sixth terminal.

8. The directional coupler according to claim 5, further comprising a seventh terminal that is a ground terminal and a termination resistor that is connected to the seventh terminal, wherein the first capacitor is connected between the point between the third terminal and the first sub-line, and the termination resistor, and the second low pass filter includes a second coil that is connected in series between the fourth terminal and the first sub-line and a second capacitor that is connected between a point between the fourth terminal and the first sub-line, and the termination resistor.

9. The directional coupler according to claim 8, wherein the first capacitor is connected between the point between the first coil and the first sub-line, and the termination resistor, and the second capacitor is connected between a point between the second coil and the first sub-line, and the termination resistor.

10. The directional coupler according to claim 1, further comprising a multilayer body including a plurality of insulator layers stacked on top of one another, wherein the main line, the first sub-line and the first low pass filter are defined by conductor layers provided on the insulator layers.

11. The directional coupler according to claim 10, wherein the main line and the first sub-line oppose each other with one of the insulator layers disposed therebetween.

12. The directional coupler according to claim 10, further comprising a shielding conductor layer that is provided between the main line and the first sub-line, and the first coil in a direction in which the layers are stacked and to which a ground potential is applied.

13. The directional coupler according to claim 12, wherein the first capacitor further includes a planar conductor layer, the main line and the first sub-line being interposed between the planar conductor layer and the shielding conductor layer in the direction in which the layers are stacked and a ground potential being applied to the planar conductor layer.

14. The directional coupler according to claim 12, wherein the first capacitor further includes a planar conductor layer, the first coil being interposed between the planar conductor layer and the shielding conductor layer in the direction in which the layers are stacked and a ground potential being applied to the planar conductor layer.

15. The directional coupler according to claim 10, wherein the main line or the first sub-line and the first low pass filter are arranged so as to be adjacent to each other in a direction perpendicular or substantially perpendicular to the direction in which the layers are stacked.

* * * * *